US007384597B2

(12) United States Patent
Ito et al.

(10) Patent No.: US 7,384,597 B2
(45) Date of Patent: Jun. 10, 2008

(54) ORGANIC SILVER SALT COMPOSITION AND MANUFACTURING METHOD THEREOF AND PHOTOTHERMOGRAPHIC MATERIAL

(75) Inventors: Satoshi Ito, Hino (JP); Kazuhiko Fujikura, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 288 days.

(21) Appl. No.: 11/219,873

(22) Filed: Sep. 7, 2005

(65) Prior Publication Data

US 2006/0057513 A1 Mar. 16, 2006

(30) Foreign Application Priority Data

Sep. 10, 2004 (JP) ..... 2004-263760

(51) Int. Cl.
*G03C 5/18* (2006.01)
*G03C 5/26* (2006.01)
*G03C 1/00* (2006.01)

(52) U.S. Cl. ..... 420/449; 430/450; 430/348; 430/618; 430/620

(58) Field of Classification Search ..... 430/449, 430/450, 348, 618, 620
See application file for complete search history.

(56) References Cited

U.S. PATENT DOCUMENTS 6,613,504 B2 * 9/2003 Oyamada et al. ..... 430/619
2003/0203323 A1 * 10/2003 Takiguchi et al. ..... 430/350

* cited by examiner

*Primary Examiner*—Geraldina Visconti
(74) *Attorney, Agent, or Firm*—Finnegan, Henderson, Farabow, Garrett & Dunner, L.L.P.

(57) ABSTRACT

An organic silver salt composition used for thermally developable photothermographic material is disclosed, comprising at least two organic acids differing in melting point and their silver salts, wherein a silver salt of a lower-melting organic acid account for 10 to 80 mol % of the silver salts and the lower melting organic acid accounting for 0 to 30 mol % of the acids. A method of manufacturing an organic silver salt compositions also disclosed.

8 Claims, 2 Drawing Sheets

ORGANIC SILVER SALT COMPOSITION AND MANUFACTURING METHOD THEREOF AND PHOTOTHERMOGRAPHIC MATERIAL

This application claims priority from Japanese Patent Application No. JP2004-263760 filed on Sep. 10, 2004, which is incorporated hereinto by reference.

FIELD OF THE INVENTION

The present invention relates to an organic silver salt composition and preparation thereof, and a photothermographic material by use thereof.

BACKGROUND OF THE INVENTION

In the field of medical treatment and graphic arts, there have been concerns in processing of imaging materials with respect to effluent produced from wet-processing, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter.

Known as such a technique are photothermographic image recoding materials comprising an organic silver salt, light-sensitive silver halide and a reducing agent on a support, as described in U.S. Pat. Nos. 3,152,904 and 3,487,075 by D, Morgan and B. Shely, and D. H. Klosterboer, "Dry Silver Photographic Material" (Handboook of Imaging Materials, Marcel Dekker Inc. page 48, 1991).

Such photothermographic image recording material which does not any solution type processing chemical, can provide users a simple and environment-friendly system.

In one aspect, this photothermographic image recording material contains light-sensitive silver halide as a photosensor and an organic silver salt as a silver ion source, which are thermally developed usually at 80 to 140° C. by a reducing agent included to form an image, without performing fixation. However, the photothermographic image recording material, in which an organic silver salt and light-sensitive silver halide are contained together with a reducing agent, easily causes fogging after raw stock and after subjected to thermal development, exposure to light over long period results in an increase of fogging.

As a technique for enhancing storage stability of photothermographic image recording material and improving fogging, there were disclosed techniques regarding improvement of organic silver salt, as described in, for example, JP-A No. 2000-62325, 2002-196446 and 2004-53985 (hereinafter, the term, JP-A refers to Japanese Patent Application Publication).

SUMMARY OF THE INVENTION

It is an object of the present invention to provide an improved organic silver salt composition and a preparation method thereof, and thermally developable photothermographic image recoding material (hereinafter, also denoted simply as photothermographic material) exhibiting improved storage stability and developability as well as enhanced sensitivity and minimized fogging.

The object of the invention was achieved by the following constitution.

Thus, in one aspect the invention is directed to an organic silver salt composition comprising at least two organic acids (1) and (2) differing in melting point and their silver salts (1') and (2'), wherein the organic acid (1) has a lower melting point than the organic acid (2) and accounting for 0 to 30 mol % of the total amount of organic acids (1) and (2); and the silver salt (1') of the organic acid (1) accounting for 10 to 80 mol % of the silver salts (1') and (2').

In another aspect the invention is directed to a method of manufacturing an organic silver salt composition by mixing solutions of alkali metal salts of two organic acids differing in melting point with a silver ion-containing solution, wherein (1) a low melting organic acid A and a high melting organic acid B are independently prepared so that the molar ratio of A:B falls within the range of 10:90 to 80:20; (2) the organic acids A and B are each independently neutralized with an alkali to form alkali metal salts of the acids A and B, while a part of each of the acids A and B remains unreacted so that the molar ratio of such an unreacted acid A (also denoted as A') to an unreacted acid B (also denoted B'), that is, the ratio of A':B' falls within the range of 0:100 to 30:70; and (3) the formed alkali metal salts of the acids A and B are each independently reacted with a silver ions to form silver salts of the acids A and B and mixed to form a silver salt composition. The molar amount of alkali metal salts of organic acids A and B, formed by neutralizing the acids with an alkali is preferably more than that of silver ions used in the reaction. In mixing the alkali metal salt solutions of A and B with a silver ion containing solution, preferably, an alkali metal salt solution of acid A is mixed with an silver ion containing solution first, an alkali metal salt solution of acid B is added preferably after adding at least 10% by weight of the alkali metal salt solution of acid A, more preferably at least 50% by weight, and still more preferably 100% by weight.

Further, in another aspect the invention is directed to a thermally developable photothermographic image recording material comprising on a support a light-sensitive layer containing a light-sensitive silver halide, a reducing agents of silver ions, a binder and a organic silver salt composition as described above.

DETAILED DESCRIPTION OF THE INVENTION

The organic silver salt composition of this invention is a mixture containing organic acids (which are hereinafter also denoted as free organic acids) and their silver salts. Thus, the organic silver salt composition is comprised of silver salts obtained by using at least two organic acids differing in melting point, in which the proportion of a silver salt of an organic acid exhibiting a lower melting point is 10 to 80 mol % of the total amount of the silver salts, and the composition further contains the organic acids and the proportion of the organic acid exhibiting a lower melting point is 0 to 30 mol % of the total amount pf the organic acid contained. In cases when three or more organic acids differing in melting point are used, two organic acids accounting for the larger amount are compared and designated as an organic acid of a lower melting point and an organic acid of a higher melting point.

In one preferred embodiment of this invention, when the organic silver salt composition is subjected to a differential scanning calorimetry (also denoted as DSC) using an empty vessel as reference in a differential scanning calorimeter while increasing a temperature at a rate of 10° C./min from 0° C. to 200° C., in the thus obtained DSC curve, the position of the peak top (or endothermic peak) arising from an organic acid exists within the range of from 65 to 95° C. (preferably from 70 to 95° C.) and the position of the peak top (or endothermic peak) of the lowest temperature side, arising from an organic silver salt exists within the range of from 95 to 120° C. (preferably from 95 to 110° C.).

Further, in the DSC curve obtained when the organic silver salt composition is subjected to a differential scanning calorimetry (also denoted as DSC) using an empty vessel as reference in a differential scanning calorimeter while first increasing the temperature at a rate of 10° C./min from 0° C. to 200° C., then, decreasing the temperature at a rate of 10° C./min from 200° C. to 0° C. and secondly increasing a temperature at a rate of 10° C./min from 0° C. to 200° C., the position of the peak top (or endothermic peak) arising from an organic acid at the time of first increasing temperature exists within the range of from 65 to 95° C. (preferably from 70 to 95° C.), and the position of the peak top (or endothermic peak) of the lowest temperature side, arising from an organic silver salt at the second time of increasing the temperature is higher by 5 to 50° C. (preferably 15 to 40° C.) than the position of the peak top (or endothermic peak) of the lowest temperature side, arising from an organic silver salt at the time of first increasing the temperature.

Figure 2:
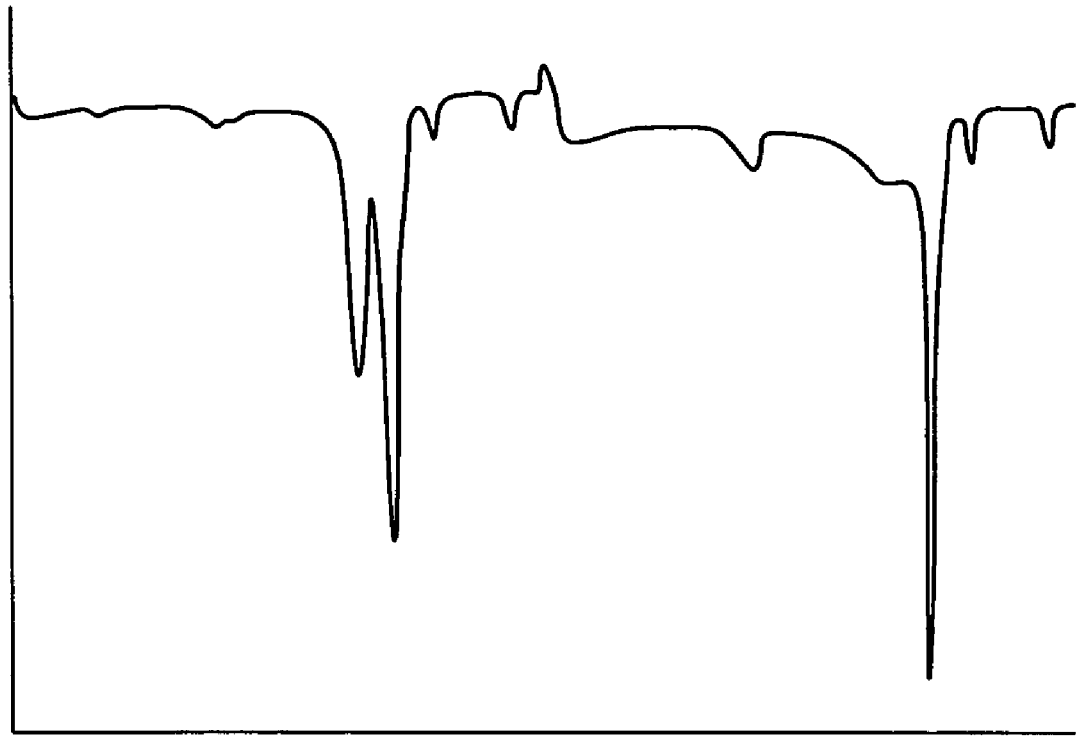
FIG. 2 is a DSC curve including an endothermic behavior.

FIG. 2 is a DSC curve showing an endothermic behavior arising from an organic silver salt.

Improvements of storage stability and developability were achieved by the foregoing, which is contemplated as follows.

The organic silver salt composition is composed of organic acids (also denoted as free organic acids) and their silver salts, in which an organic acid exhibiting a higher melting point enhances storage stability. For example, behenic acid (having a melting point of ca. 71° C.) exhibits superior storage stability, compared to stearic acid (having a melting point of ca. 63° C.). However, the endothermic peak of behenic acid in the DSC curve shifts to a higher temperature, resulting in deterioration in developability. The endothermic peak of organic silver salts is lowered by adding silver stearate or a mixture of stearic acid and behenic acid. However, adding stearic acid or behenic acid simply results in a mixed composition of free acids and also results in lowering the melting point (for example, a mixture of stearic acid and behenic acid in a ratio of 5:5 results in a melting point of approximately 57° C.), thereby leading to deterioration in storage stability. Accordingly compatibility of storage stability and developability can be achieved by using behenic acid as a free acid and forming the endothermic peak with a mixed composition. Further, in the second scan of the DSC which corresponds to the state after thermal development (i.e., the temperature is first increased to 200° C. at a rate of 10° C./min, then, the temperature is decreased to 0° C. at a rate of 10° C./min, and then, the temperature is increased a second time to 200° C. at a rate of 10° C./min)

In the method of manufacturing an organic silver salt composition which is formed by mixing a solution of alkali metal salts of two organic acids differing in melting point with a silver ion-containing solution, (1) a low melting organic acid A and a high melting organic acid B are independently prepared so that the molar ratio of A:B falls within the range of 10:90 to 80:20; (2) organic acids A and B are each independently neutralized with an alkali to form solutions containing alkali metal salts of the acids A and B, together with acid A or B remained as an un-neutralized acid in a molar ratio of A to B of 0:100 to 30:70 and (3) the formed alkali metal salt solutions of A and B are mixed with a silver ion containing solution to form silver salts of organic acids A and B. The molar amount of alkali metal salts of organic acids A and B, formed by neutralizing the acids with an alkali is preferably more than that of silver ions used in the reaction. In mixing alkali metal salt solutions of A and B with a silver ion containing solution, preferably, an alkali metal salt solution of acid A is first mixed with an silver ion containing solution, and an alkali metal salt solution of acid B is added preferably after adding at least 10% by weight of the alkali metal salt solution of acid A, more preferably at least 50% by weight, and still more preferably 100% by weight.

Organic silver salts usable in the invention which are relatively stable to light, form silver images when heated at a temperature of 80° C. or more in the presence of light-exposed photocatalyst (for example, latent images of light-sensitive silver halide) and a reducing agent. Such light-insensitive organic silver salts are described in JP-A No. 10-62899, paragraph [0048]-[0049]; European Patent Application Publication (hereinafter, denoted simply as EP-A) No. 803,764A1, page 18, line 24 to page 24, line 37; EP-A No. 962,812A1; JP-A Nos. 11-349591, 2000-7683, 2000-72711, 2002-23301, 2002-23303, 2002-4-9119, 2002-196446; EP-A Nos. 1246001A1 and 1258775A1; JP-A Nos. 2003-140290, 2003-195445, 2003-295378, 2003-295379, 2003-295380 and 2003-295381. Of organic silver salts, silver salts of long chain aliphatic carboxylic acids having 10 to 30 carbon atoms (preferably 15 to 28 carbon atoms) are preferred. Preferred examples of an organic silver salt include silver behenate, silver arachidate, silver stearate and their mixture in which the content of silver behenate is preferably from 50 to 100 mol % and more preferably 80 to 100 mol %.

The grain size distribution of an organic silver salt is preferably monodisperse. The expression, being monodisperse means that the percentage (that is a coefficient of variation) of the standard deviation of volume-weighted grain size, divided by an average volume-weighted grain size is preferably less than 100%, more preferably not more than 80%, and still more preferably not more than 50%. The measurement thereof is carried out, for example, as follows. To an organic silver salt dispersed in liquid, laser light is irradiated and an auto-correction function v.s. time change of fluctuation of scattered light to determine the grain size (volume-weighted average grain size).

The silver salt composition of this invention is prepared preferably at a reaction temperature of not more than 60° C. in terms of preparing grains exhibiting the lower minimum concentration. The temperature of chemicals to be added, for example, an aqueous solution of an acid alkali metal salt may be more than 60° C. but the temperature of a reaction vessel to which a reaction solution is to be added, is preferably not more than 60° C., more preferably not more than 50° C., and still more preferably not more than 40° C.

The pH of a silver ion containing solution (e.g., an aqueous silver nitrate solution) is preferably from 1 to 6, and more preferably 1.5 to 4. An acid or alkali may be added to the silver ion containing solution to adjust the pH value, for which any kind of an acid or alkali is usable.

After completing addition of a silver ion containing solution (e.g., an aqueous silver nitrate solution) and/or an organic acid alkali metal salt solution or suspension, the organic silver salt may be heated to perform ripening. In this invention, the ripening temperature is distinguished from the reaction temperature described above. In the course of ripening, a silver ion containing solution and an organic acid alkali metal salt solution or suspension are never added. Ripening is conducted preferably at a temperature of a reaction temperature minus 20° C. to that of the reaction temperature plus 20° C., more preferably at a temperature of a reaction temperature plus 1° C. to that of the reaction temperature plus 10° C. The ripening time is optimally determined.

In the preparation of the silver salt composition, a silver ion containing solution and an organic acid alkali metal salt solution may be mixed by any method. For example, Mixing by stirring, which can be easily controlled at low cost, is preferred. Any mixing method of a batch type, a continuous type, an external mixing and the like is applicable. For example, a method in which one of an organic acid alkali metal salt solution and a silver ion containing solution is used as mother liquor and the other solution is added thereto with stirring the mother liquor, or a method in which a mother liquor is externally circulated and the other solution is added to a mixer provided in the external circulation route.

Further, a method in which an organic acid alkali metal salt solution and a silver ion containing solution are simultaneously added by controlled double-jet addition to a hydrophilic solvent as a mother liquor with stirring, a method in which a mother liquor is externally circulated, and an organic acid alkali metal salt solution and a silver ion containing solution are simultaneously added by controlled double-jet addition to a mixed provided in the route of external, and a method in which an organic acid alkali metal salt solution and a silver ion containing solution are supplied to a continuous-mixing means to perform continuous preparation of an organic silver salt composition are also preferable from the viewpoint of dispersion of an organic silver salt composition. In cases when using a mother liquor, a solution may be added onto the surface of the mother liquor or into the interior of mother liquor, and addition into the interior of mother liquor is preferred. Either a dynamic mixer internally provided with a stirring means or a static mixer provided with no internal stirring means is usable in this invention, but a static mixer is preferred in terms of no internal retention. Stirring is conducted preferably at a Reynolds number of at least 1,000, more preferably at least 3,000 and still more preferably at least 5,000.

In the preparation of the organic silver salt composition of this invention, 0.5 to 30 mol % (preferably 3 to 20 mol %) of an organic acid alkali metal salt solution may be added singly after completing addition of a silver ion containing solution. Preferably, this addition is performed as one of divided additions. The foregoing addition may be performed into an enclosed mixing means or a reaction vessel but addition into a reaction vessel is preferred. Performing such addition can enhance hydrophilicity of the surface of organic silver salt composition, thereby enhancing film-forming capability of photothermographic material and preventing peeling.

The silver ion concentration of a silver ion containing solution (e.g., silver nitrate solution) is optional and preferably 0.03 to 6.5 mol/L, and more preferably 0.1 to 5 mol/L.

In the formation of the organic silver salt composition, at least one of a silver ion containing solution, an organic acid alkali metal salt solution and a solution to be prepared in advance in a reaction field contains an organic solvent preferably in such an amount that the organic acid alkali metal salt becomes substantially transparent solution, not a string-form aggregate or micelles. Such a solution contains preferably water or an organic solvent alone, or a mixture water and an organic solvent, and more preferably a mixture of water and an organic solvent.

Any organic solvent which is water-soluble and exhibits the foregoing properties, is usable in this invention, but one which adversely affects photographic performance, is not preferable. Water-miscible alcohol or acetone is preferred.

Examples of an alkali usable in this invention include sodium hydroxide, potassium hydroxide and lithium hydroxide. Of these, sodium hydroxide and potassium hydroxide are preferred and potassium hydroxide is more preferred in terms of lowering the viscosity of the organic acid alkali metal salt solution.

An alkali metal salt of an organic acid can be prepared by adding an alkali to the organic acid, in which it is preferred to add an alkali at an amount less than the equimolar amount of the organic acid, whereby unreacted organic acid remains. The residual organic acid content is preferably from 3 to 50 mol %, based on the whole organic acids, and more preferably from 3 to 30 mol %. Alternatively, after addition of an alkali at an amount more than the intended amount, an acid such as nitric acid or sulfuric acid may be added thereto to neutralize the excessive alkali. To a solution of an external mixing means to which a silver ion containing solution or an organic acid alkali metal salt solution is added, there may be added, for example, a compound of formula (1) described in JP-A No. 62-65035, a N-containing heterocyclic compound containing a water-solubilizing group described in JP-A No. 62-150240, an inorganic peroxide compound described in JP-A No. 50-101019, a sulfur compound described in JP-A No. 51-78319, a disulfide compound described in JP-A No. 57-643 and hydrogen peroxide.

Organic acids forming an organic acid alkali metal salt are preferably aliphatic carboxylic acids and specifically, behenic acid, arachidic acid, stearic acid, and palmitic acid are more preferred.

The organic solvent content of an organic acid alkali metal salt solution or suspension used in this invention is preferably 3% to 70% by volume based on the water content, and more preferably 5% to 50%. This organic solvent content, which is variable with the reaction temperature, can be optimized by trial and error. The concentration of an organic acid alkali metal salt is usually from 5% to 50% by weight, preferably from 7% to 45% by weight, and more preferably from 10% to 40% by weight.

An organic acid alkali metal salt solution or suspension to be supplied to the reaction vessel is maintained at the temperature necessary to avoid crystallization or solidification of the organic acid alkali metal salt, preferably at 50 to 90° C., more preferably 60 to 85° C. and still more preferably 65 to 85° C. To control the reaction at a given temperature, it is preferred to keep it at a temperature chosen from the foregoing range. Thereby, the rate at which a heated solution or suspension of organic acid alkali metal salt forms crystalline precipitates upon cooling in an external mixing means and the rate of forming an organic silver salt upon reaction with a silver ion containing solution are suitably controlled, whereby the crystal form, the crystal size and the crystal size distribution can be preferably controlled. Further, enhanced performance of photothermographic material can be achieved at the same time.

A solvent may be added to the reaction vessel in advance and water is preferably used as such a solvent but a solvent used in an organic acid alkali metal salt solution or suspension is also preferred.

A dispersion aid, soluble in an aqueous medium, may be added to an organic acid alkali metal salt solution or suspension, to a silver ion containing solution or to a reaction solution. Any compound capable of dispersing the formed organic silver salt is usable as a dispersing aid.

In the formation of an organic silver salt, it is preferred to conduct desalting and dewatering. Commonly known or conventionally used methods are applicable. Examples thereof include centrifugal filtration, suction filtration, ultrafiltration, flocculation washing and centrifugal sedimentation. Of these, centrifugal separation is preferred. Desalting and dewatering may be carried out a single time or repeated plural times. Addition or removal of water may be conducted continuously or separately. Desalting/dewatering is conducted until finally removed water preferably reaches a conductivity of 300 μS/cm or less, more preferably 100 μS/cm or less, and still more preferably 60 μS/cm or less. In that case, the lower limit of conductivity is not specifically limited but it is usually a level of 5 μS/cm.

Prior to ultrafiltration, the solution is dispersed in advance to reduce the particles size to approximately 2 times of the volume-average size of final particles. Any dispersing means is applicable, such as a high-pressure homogenizer or a micro-fluidizer.

The liquid temperature after grain formation and before desalting is maintained preferably as low as possible. This is because an organic solvent used to dissolve an organic acid alkali metal salt permeates into the formed organic silver salt composition, easily forming silver nucleuses during the liquid-supplying operation or a desalting operation. Accordingly, desalting is carried out, while maintaining a dispersion of an organic silver salt composition at a temperature of 1 to 30° C., preferably 5 to 25° C.

There will be hereinafter described light-sensitive silver halide grains (also denoted simply as silver halide grains) used for the photothermographic material.

Light-sensitive silver halide grains used in this invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide. The iodide content of silver iodobromide is preferably 0.02 to 16 mol %, based on Ag. Iodide may be distributed overall within a silver halide grain or may be localized in a specific portion, for example, a core/shell structure in which is high iodide in the central portion of the grain and low or substantially zero iodide in the vicinity of the grain surface.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not less than 0.030 μm and not more than 0.055 μm, when grains of less than 0.02 μm are neglected. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size=standard deviation of grain diameter/average grain diameter×100 (%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

In the preparation of silver halide grains, it is preferred to use a polyethylene oxide compound represent by the following formula, specifically in the nucleation stage:

$$YO(CH_2CH_2O)m(C(CH_3)CH_2O)p(CH_2CH_2O)nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into a light-sensitive layer by any means, in which silver halide is arranged so as to be as close to reducible silver source as possible to obtain a photothermographic material exhibiting enhanced sensitivity and covering power (CP). It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting quality is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection.

The important points for achieving technologies for antifogging and image stabilizing are to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of this invention will now be described.

In the photothermographic material of, one of the features is that bisphenols are mainly employed as a reducing agent, as described below. It is preferable that compounds are incorporated which are capable of deactivating reducing agents upon generating active species capable of extracting hydrogen atoms from the foregoing reducing agents. Preferred compounds are those which are capable of: preventing the reducing agent from forming a phenoxy radial; or trapping the formed phenoxy radial so as to stabilize the phenoxy radial in a deactivated form to be effective as a reducing agent for silver ions. Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amide group, an ester group, a urethane group, a ureido group, a tertiary amino group, or a nitrogen containing aromatic group. More preferred are compounds having a sulfonyl group, a sulfoxide group or a phosphoryl group in the molecule. Specific examples are disclosed in, JP-A Nos. 6-208192, 20001-

215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to this invention, specific examples of preferred compounds include halogen radical releasing compounds which are represented by the following formula (OFI):

$$Q_2\text{-Y—C}(X_1)(X_3)(X_2) \qquad \text{formula (OFI)}$$

wherein $Q_2$ is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(═O)—, —SO— or —$SO_2$—. The aryl group represented by $Q_2$ may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by $Q_2$ is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by $Q^2$ may be substituted by a substituent, in addition to —Y—C$(X_1)(X_2)(X_3)$. Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(═O)—, —SO—, and —$SO_2$—, and preferably —$SO_2$—.

The addition amount of these compounds is preferably from $1\times10^{-4}$ to 1 mol, and more preferably from $1\times10^{-3}$ to $5\times10^{-2}$ mol per mol of silver.

Compounds disclosed in JP-A No. 2003-5041 can also be used similarly to the compounds represented by the foregoing formula (OFI).

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in JP-A No. 2003-91054. Specifically, in the photothermographic imaging materials according to the present invention, desired results are unexpectedly obtained.

Further, other than the above-mentioned compounds, compounds which are conventionally known as an antifogging agent may be incorporated in the silver salt photothermographic materials of the present invention. For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

In the imaging materials according to the present invention, it is preferable to use the compounds represented by the following formula (PC) as an antifogging agent and a storage stabilizer:

$$R\text{—(CO—O-M)}_n \qquad \text{formula (PC)}$$

wherein R represents a linkable atom, an aliphatic group, an aromatic group, a heterocyclic group, or a group of atoms capable of forming a ring as they combine with each other; M represents a hydrogen atom, a metal atom, a quaternary ammonium group, or a phosphonium group; and n represents an integer of from 2 to 20.

Listed as linkable atoms represented by R are those such as nitrogen, oxygen, sulfur or phosphor.

Listed as aliphatic groups represented by R are straight or branched alkyl, alkenyl, alkynyl, and cycloalkyl groups having 1 to 30 and preferably 1 to 20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by R are those having 6 to 20 carbon atoms, and specific examples include phenyl, naphthyl, and anthranyl groups.

Heterocyclic groups represented by R may be in the form of a single ring or a condensed ring and include 5- or 6-membered heterocyclic groups which have at least O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which R is formed employing $R_1$ and $R_2$, each $R_1$ or $R_2$ is defined as R, and $R_1$ and $R_2$ may be the same or different. Rings which are formed employing $R_1$ and $R_2$ include 4- to 7-membered rings. Of these, are preferred 5- to 7-membered rings. Preferred groups represented by $R_1$ and $R_2$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyl group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimethylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_1$ and $R_2$ may each have a single substituent or a plurality of substituents selected from the above. Further, each of the substituents maybe further substituted with the above substituents. Still further, $R_1$ and $R_2$ may be the same or different. Yet further, when Formula (PC-1) is an oligomer or a polymer $(R—(COOM)_{n0})_m$, desired effects are obtained, wherein n is preferably 2-20, and m is preferably 1 to 100, or the molecular weight is preferably not more than 50,000.

Further preferably employed are simultaneously dicarboxylic acids described in JP-A Nos. 58-95338, 10-288824, 11-174621, 11-218877, 2000-10237, 2000-10236, and 2000-10231.

It is preferable that imaging materials according to the present invention contain thiosulfonic acid compounds as a inhibitor, represented by the following formula (ST):

$$Z\text{-}SO_2.S\text{-}M \qquad \text{formula (ST)}$$

wherein Z is a substituted or unsubstituted alkyl, aryl or heterocyclic group, and M is a metal atom or an organic cation.

In the compounds represented by Formula (ST), the alkyl group, aryl group, heterocyclic group, aromatic ring and heterocyclic ring, which are represented by Z may be substituted. Listed as the substituents may be, for example, a lower alkyl group such as a methyl group or an ethyl group, an aryl group such as a phenyl group, an alkoxyl group having 1-8 carbon atoms, a halogen atom such as chlorine, a nitro group, an amino group, or a carboxyl group. Metal atoms represented by M are alkaline metals such as a sodium ion or a potassium ion, while as the organic cation preferred are an ammonium ion or a guanidine group.

The added amount of the compounds represented by Formula (ST) is not particularly limited, but is preferably in the range of $1\times10^{-6}$-1 g per mol of the total silver amount, including silver halides.

Further, similar compounds are also disclosed in JP-A No. 8-314059.

In the present invention, it is preferable to use the fog restrainers represented by the following formula (CV), that is, vinyl type restrainers containing an electron-withdrawing group. Thus, the photothermographic material preferably contains a compound represented by the following formula (CV):

formula (CV)

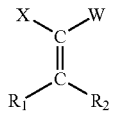

wherein, X represents an electron-withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form.

An electron-withdrawing group represented by X is a substituent, Hammett's constant "σp" of which is positive. Specific example thereof include substituted alkyl groups (such as halogen-susbstituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. Provided that X does not represent a formyl group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group. In addition to electron-withdrawing groups having a positive Hammett's substituent constant σp, except a formyl group, aryl groups and heterocyclic groups are also preferred as W.

X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, in this invention, any of X, W and $R_2$ may contain a ballast group. A ballast group means a so-called ballast group in such as a photographic coupler, which makes the added compound have a bulky molecular weight not to migrate in a coated film of a light-sensitive material.

Further, in this invention, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of X and W represents a cyano group, or X and W form a cyclic structure by bonding to each other. Further, compounds in which a thioether group (—S—) is contained in the substituents represented by X, W and $R_2$ are preferred in this invention. Furthermore, preferable are those in which at least one of X and W is provided with an alkene group represented by following Formula (CV1):

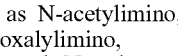

—C(R)=C(Y)(Z) formula (CV1)

wherein, R represents a hydrogen atom or a substituent, Y and Z each represent a hydrogen atom or a substituent, however, at least one of Y and Z represents an electron-withdrawing group.

In this present invention, there may be employed, as a reducing agent for silver ions (hereinafter occasionally referred simply to as a reducing agent), polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by the following formula (RED):

formula (RED)

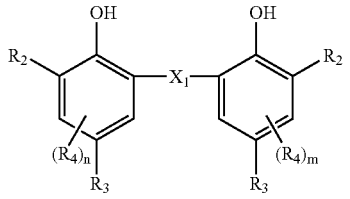

wherein $X_1$ represents a chalcogen atom or $CHR_1$, in which $R_1$ represents a hydrogen atom, a halogen atom, an alkyl group, an alkenyl group, an alkynyl group, an aryl group or a heterocyclic group; $R_2$ represents an alkyl group; $R_3$ represents a hydrogen atom or a substituent capable of being substituted on a benzene ring; $R_4$ represents a substituent capable of being substituted on a benzene ring; m and n are each an integer of 0 to 2.

In the formula (RED), $X_1$ represents a chalcogen atom or $CHR_1$. Specific examples of a chalcogen atom include a sulfur atom, a selenium atom, and a tellurium atom. Of these, a sulfur atom is preferred. In the foregoing $CHR_1$, $R_1$ represents a hydrogen atom, a halogen atom, an alkyl group, an alkenyl group, an alkynyl group, an aryl group or a heterocyclic group. Halogen atoms include, for example, a fluorine atom, a chlorine atom, and a bromine atom. Examples of an alkyl group include alkyl groups having 1-20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Examples of the substituents include a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Of these, an alkyl group is specifically preferred.

$R_2$ represents an alkyl group. Preferred as the alkyl groups are those, having 1-20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2-20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

$R_3$ preferably is methyl, ethyl, i-propyl, t-butyl, cyclohexyl, 1-methylcyclohexyl, or 2-hydroxyethyl. Of these, 2-hydroxyethyl is more preferred.

These groups may further have a substituent. Employed as such substituents may be those listed in aforesaid $R_1$.

Further, $R_3$ is more preferably an alkyl group having 1 to 10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being deprotected. In order to achieve high maximum density (Dmax) at a definite silver coverage, namely to result in silver image density of high covering power (CP), sole use or use in combination with other kinds of reducing agents is preferred.

The most preferred combination of $R_2$ and $R_3$ is that $R_2$ is a tertiary alkyl group (t-butyl, or 1-methylcyclohexyl) and $R_3$ is an alkyl group, such as a 2-hydoxyethyl group, which has, as a substituent, a hydroxyl group or a group capable of forming a hydroxyl group while being deprotected. Incidentally, a plurality of $R_2$ and $R_3$ is may be the same or different.

$R_4$ represents a group capable of being substituted to a benzene ring. Listed as specific examples may be an alkyl group having 1-25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0-2. However, the most preferred case is that both n and m are 0. A plurality of $R_4$s may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

Specific examples of the compounds represented by formula (RED) are listed below. However, the present invention is not limited thereto.

(RED-1)

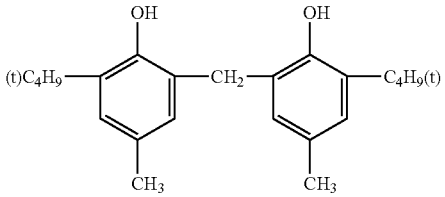

(RED-2)

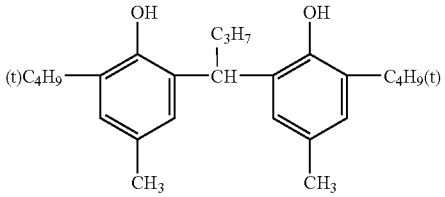

(RED-3)

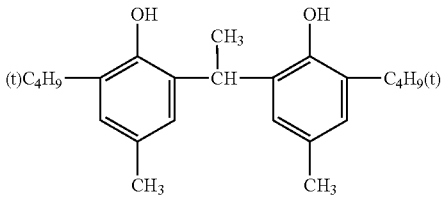

(RED-4)

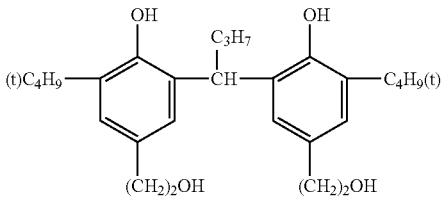

-continued (RED-5)

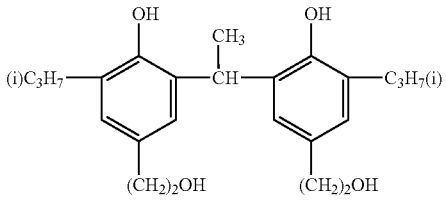

(RED-6)

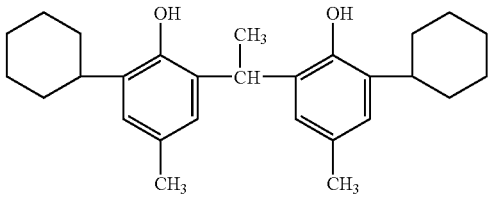

(RED-7)

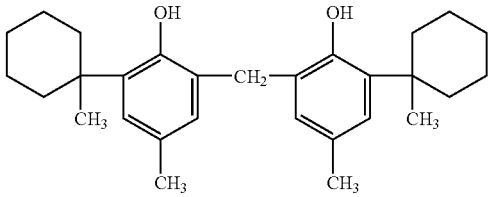

(RED-8)

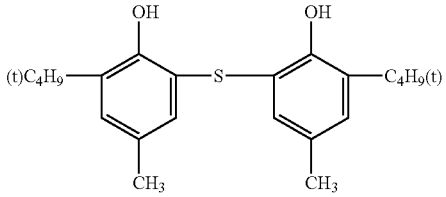

(RED-9)

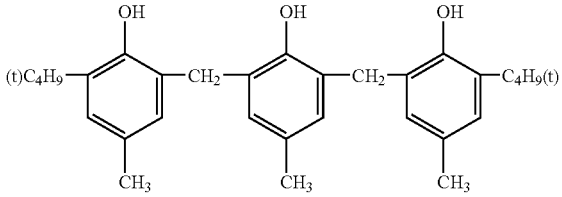

(RED-10)

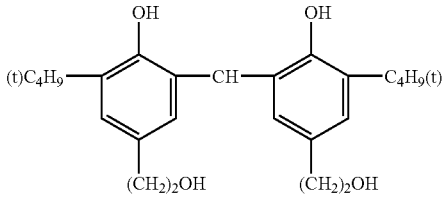

(RED-11)

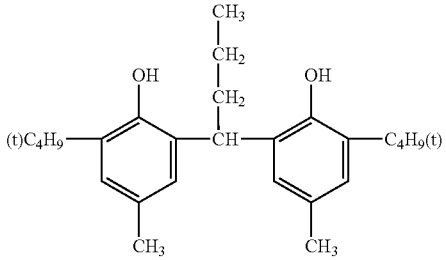

-continued
(RED-12)
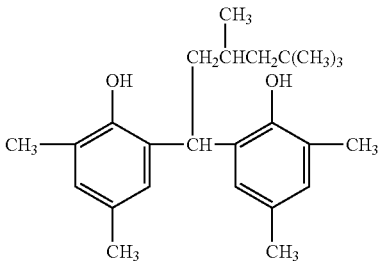
(RED-13)
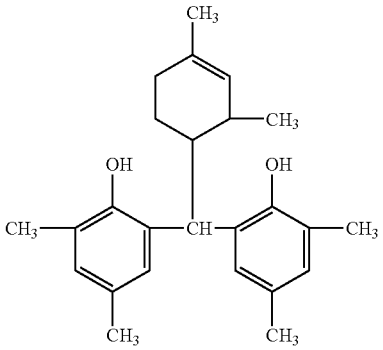
(RED-14)
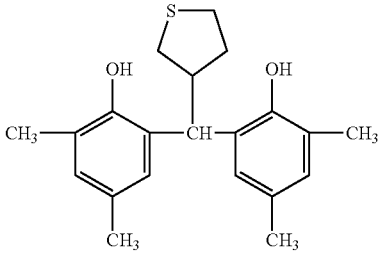
(RED-15)
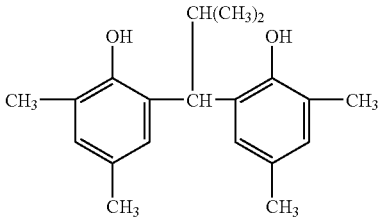
(RED-16)
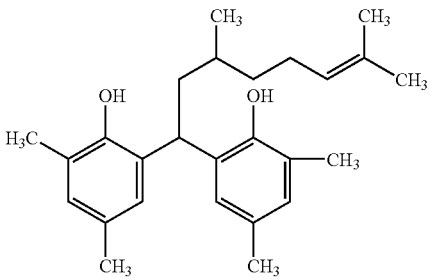
-continued
(RED-17)
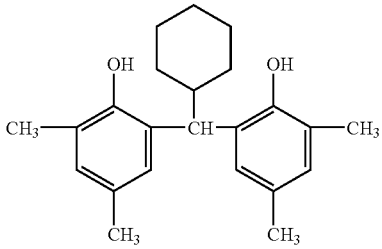
(RED-18)
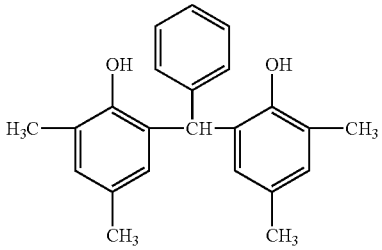
(RED-19)
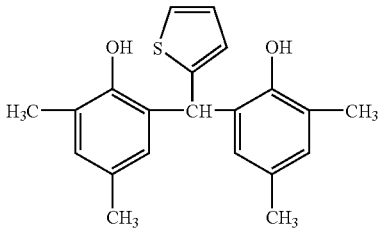
(RED-20)
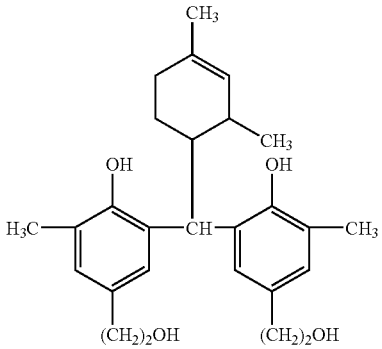
(RED-21)
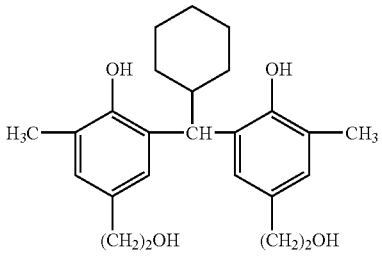
It is possible to synthesize these compounds (bisphenol compounds) represented by Formula (RED) employing conventional methods known in the art (for example, referred to Japanese Patent Application No. 2002-147562).

The amount of silver ion reducing agents employed in the photothermographic materials of the present invention varies depending on the types of organic silver salts, reducing agents and other additives. However, the aforesaid amount is customarily 0.05-10 mol per mol of organic silver salts, and is preferably 0.1-3 mol. Further, in the aforesaid range, silver ion reducing agents of the present invention may be employed in combinations of at least two types. Namely, in view of achieving images exhibiting excellent storage stability, high image quality and high CP, it is preferable to simultaneously use reducing agents which differ in reactivity, due to a different chemical structure.

In the present invention, preferred cases occasionally occur in which the aforesaid reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by Formulas (1) to (4) in JP-A No. 2003-43614, and Formulas (1) to (3) in JP-A No. 2003-66559 are preferably employed as a development accelerator which are simultaneously employed with the aforesaid reducing agents.

The oxidation potential of development accelerators employed in the silver salt photothermographic materials of the present invention, which is determined by polarographic measurement, is preferably lower 0.01 to 0.4 V, and is more preferably lower 0.01 to 0.3 V than that of the compounds represented by general formula (RED). Incidentally, the oxidation potential of the aforesaid development accelerators is preferably 0.2 to 0.6 V, which is polarographically determined in a solvent mixture of tetrahydrofuran:Britton Robinson buffer solution=3:2 the pH of which is adjusted to 6 employing an SCE counter electrode, and is more preferably 0.3 to 0.55 V. Further, the pKa value in a solvent mixture of tetrahydrofuran:water=3:1 is preferably 3 to 12, and is more preferably 5 to 10. It is particularly preferable that the oxidation potential which is polarographically determined in the solvent mixture of tetrahydrofuran:Britton Robinson buffer solution=3:2, the pH of which is adjusted to 6, employing an SCE counter electrode is 0.3 to 0.55, and the pKa value in the solvent mixture of tetrahydrofuran: water=3:2 is 5 to 10.

Further, as silver ion reducing agents according to the present invention, there may be employed various types of reducing agents disclosed in European Patent No. 1,278,101 and JP-A No. 2003-15252.

In the present invention, preferred cases occasionally occur in which when the aforesaid reducing agents are added to and mixed with a photosensitive emulsion comprised of photosensitive silver halide, organic silver salt particles, and solvents just prior to coating, and then coated, variation of photographic performance during standing time is minimized.

Silver halide grains used in the invention can be subjected to chemical sensitization. In accordance with methods described in JP-A Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In this invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double-bond. Specifically, heterocycle-containing thiourea derivatives and triphenylphosphine sulfide derivatives are preferred. A variety of techniques for chemical sensitization employed in silver halide photographic material for use in wet processing are applicable to conduct chemical sensitization, as described, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998). The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

When the surface of silver halide grains is subjected to chemical sensitization, it is preferred that an effect of the chemical sensitization substantially disappears after subjected to thermal development. An effect of chemical sensitization substantially disappearing means that the sensitivity of the photothermographic material, obtained by the foregoing chemical sensitization is reduced, after thermal development, to not more than 1.1 times that of the case not having been subjected to chemical sensitization. To allow the effect of chemical sensitization to disappear, it is preferred to allow an oxidizing agent such as a halogen radical-releasing compound which is capable of decomposing a chemical sensitization center (or chemical sensitization nucleus) through an oxidation reaction to be contained in an optimum amount in the light-sensitive layer and/or the light-insensitive layer. The content of an oxidizing agent is adjusted in light of oxidizing strength of an oxidizing agent and chemical sensitization effects.

There may be further used sensitizing dyes other than those described above as long as they do not result in adversely effects. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The photothermographic material preferably contains at least one of sensitizing dyes described in Japanese Patent Application No. 2003-102726, represented by the following formulas (SD-1) and (SD-2):

formula (SD-1)

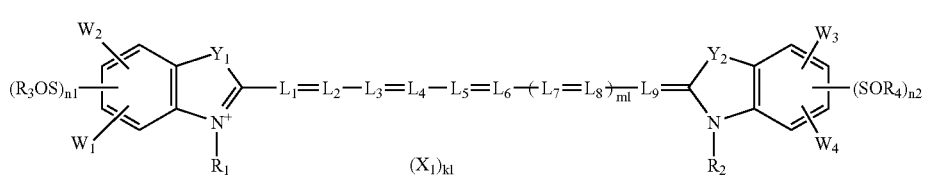

formula (SD-2)

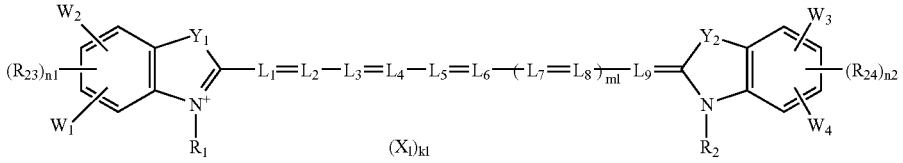

wherein $Y_1$ and $Y_2$ are each an oxygen atom, a sulfur atom, a selenium atom or —CH=CH—; $L_1$ to $L_9$ are each a methine group; $R_1$ and $R_2$ are an aliphatic group; $R_3$, $R_4$, $R_{23}$ and $R_{24}$ are each a lower alkyl group, a cycloalkyl group, an alkenyl group, an aralkyl group, an aryl group or a heterocyclic group; $W_1$, $W_2$, $W_3$ and $W_4$ are each a hydrogen atom, a substituent or an atom group necessary to form a ring by $W_1$ and $W_2$ or $W_3$ and $W_4$, or an atom group necessary to form a 5- or 6-membered ring by $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ is an ion necessary to compensating for a charge within the molecule; k1 is the number of ions necessary to compensate for a charge within the molecule; m1 is 0 or 1; n1 and n2 are each 0, 1 or 2, provided that n1 and n2 are not 0 at the same time.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization, expansion or adjustment of the light-sensitive wavelength region. A super-sensitizing compound, such as a dye which does not exhibit spectral sensitization or substance which does not substantially absorb visible light may be incorporated, in combination with a sensitizing dye, into the emulsion containing silver halide and organic silver salt used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula is preferred as a supersensitizer:

Ar—SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferably1 1 to 4 carbon atoms) or an alkoxy group (having one or more carbon atoms, and preferably1 1 to 4 carbon atoms). In addition to the foregoing supersensitizers, there are usable heteroatom-containing macrocyclic compounds described in JP-A No. 2001-330918, as a supersensitizer. The supersensitizer is incorporated into a light-sensitive layer containing organic silver salt and silver halide grains, preferably in an amount of 0.001 to 1.0 mol, and more preferably 0.01 to 0.5 mol per mol of silver.

It is preferred that a sensitizing dye is allowed to adsorb onto the surface of light-sensitive silver halide grains to achieve spectral sensitization and the spectral sensitization effect substantially disappears after being subjected to thermal development. The effect of spectral sensitization substantially disappearing means that the sensitivity of the photothermographic material, obtained by a sensitizing dye or a supersensitizer is reduced, after thermal development, to not more than 1.1 times that of the case not having been subjected to spectral sensitization. To allow the effect of spectral sensitization to disappear, it is preferred to use a spectral sensitizing dye easily releasable from silver halide grains and/or to allow an oxidizing agent such as a halogen radical-releasing compound which is capable of decomposing a spectral sensitizing dye through an oxidation reaction to be contained in an optimum amount in the light-sensitive layer and/or the light-insensitive layer. The content of an oxidizing agent is adjusted in light of oxidizing strength of the oxidizing agent and its spectral sensitization effects.

The light-sensitive layer or light-insensitive layer may contain a silver saving agent.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. The silver-saving agent may be contained in either the light-sensitive layer or light-insensitive layer, or in both of them.

Examples of the preferred silver-saving agent include hydrazine derivative compounds represented by the following formula [H], vinyl compounds represented by formula (G) and quaternary onium compounds represented by formula (P):

formula [H]

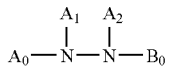

formula (G)

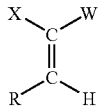

formula (P)

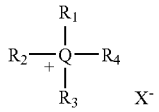

In formula [H], $A_0$ is an aliphatic group, aromatic group, heterocyclic group, each of which may be substituted, or $-G_0-D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, $—C(=NG_1D_1)-$, —SO—, $—SO_2—$ or $—P(O)(G_1D_1)-$ group, in which $G_1$ is a bond, or a —O—, —S— or $—N(D_1)-$ group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or $-G_0-D_0$ group represented by $A_0$ each may be substituted. Specifically preferred $A_0$ is an aryl group or $-G_0-D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert. The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In the foregoing formula (H), $B_0$ is a blocking group, and preferably $-G_0-D_0$, wherein $G_0$ is a —CO—, —COCO—, —CS—, $—C(=NG_1D_1)-$, —SO—, $—SO_2—$ or $—P(O)(G_1D_1)-$ group, and preferred $G_0$ is a —CO—, —COCOA-, in which $G_1$ is a linkage, or a —O—, —S— or $—N(D_1)-$ group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

The compounds of formulas (H) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonium group, a phophonium group, pyrilium group and inmonium grou, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

The quaternary onium salt compounds described above can be readily synthesized according to the methods commonly known in the art. For example, the tetrazolium compounds described above may be referred to Chemical Review 55, page 335-483.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in Japanese Patent Application No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

Suitable binders for the silver salt photothermographic material are to be transparent or translucent and commonly colorless, and include natural polymers, synthetic resin polymers and copolymers, as well as media to form film. The binders include, for example, gelatin, gum Arabic, casein, starch, poly(acrylic acid), poly(methacrylic acid), poly(vinyl chloride), poly(methacrylic acid), copoly(styrene-maleic anhydride), coply(styrene-acrylonitrile), coply (styrene-butadiene), poly(vinyl acetals) (for example, poly (vinyl formal) and poly(vinyl butyral), poly(esters), poly (urethanes), phenoxy resins, poly(vinylidene chloride), poly (epoxides), poly(carbonates), poly(vinyl acetate), cellulose esters, poly(amides). The binders may be hydrophilic ones or hydrophobic ones.

Preferable binders for the photosensitive layer of the photothermographic material of this invention are poly (vinyl acetals), and a particularly preferable binder is poly (vinyl butyral), which will be detailed hereunder. Polymers such as cellulose esters, especially polymers such as triacetyl cellulose, cellulose acetate butyrate, which exhibit higher softening temperature, are preferable for an over-coating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

In this invention, it is preferable that thermal transition point temperature, after development is at higher or equal to 100° C., is from 46 to 200° C. and is more preferably from 70 to 105° C. Thermal transition point temperature, as described in this invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of this invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, this invention was achieved.

The glass transition temperature (Tg) is determined employing the method, described in Brandlap, et al., "Polymer Handbook", pages from III-139 through III-179, 1966 (published by Wiley and Son Co.). The Tg of the binder composed of copolymer resins is obtained based on the following formula.

$$Tg \text{ of the copolymer (in ° C.)} = v_1 Tg_1 + v_2 Tg_2 + \ldots + v_n Tg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

In the silver salt photothermographic material of this invention, employed as binders, which are incorporated into the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Ethylenically unsaturated monomers as constitution units forming homopolymers or copolymers include alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy)ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, there may be employed the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, preferable examples include alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by formula (V) described below:

formula (V)

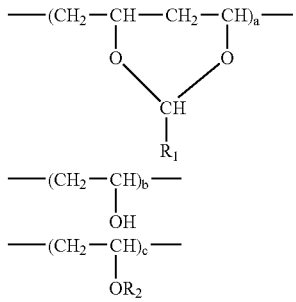

wherein $R_1$ represents a substituted or unsubstituted alkyl group, and a substituted or unsubstituted aryl group, however, groups other than the aryl group are preferred; $R_2$ represents a substituted or unsubstituted alkyl group, a substituted or unsubstituted aryl group, —$COR_3$ or —$CONHR_3$, wherein $R_3$ represents the same as defined above for $R_1$.

Unsubstituted alkyl groups represented by $R_1$, $R_2$, and $R_3$ preferably have 1 to 20 carbon atoms and more preferably have 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_2$ is preferably —$COR_3$ (wherein $R_3$ represents an alkyl group or an aryl group) and —$CONHR_{53}$ (wherein $R_3$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in this invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —$N(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/$mm^2$.

Polymers represented by aforesaid Formula (V) of this invention can be synthesized employing common synthetic methods described in "Sakusan Binihru Jushi (Vinyl Acetate Resins)", edited by Ichiro Sakurada (Kohbunshi Kagaku Kankoh Kai, 1962).

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer | Acetoacetal (mol %) | Butyral (mol %) | Acetal (mol %) | Acetyl (mol %) | Hydroxyl Group (mol %) | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd.

Incidentally, in Table 1, P-9 is a polyvinal butyral resin B-79, manifactured by Solutia ltd.

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as shown below.

As one of preferred cross-linking agents, isocyanate based and thioisocyanate based cross-linking agents represented by formula (IC), shown below, will now be described:

$$X{=}C{=}N\text{-}L\text{-}(N{=}C{=}X)_v \qquad \text{formula (IC)}$$

wherein v represents 1 or 2; L represents an alkyl group, an aryl group, or an alkylaryl group which is a linking group having a valence of v+1; and X represents an oxygen atom or a sulfur atom.

Incidentally, in the compounds represented by aforesaid Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The aforesaid isocyanate based cross-linking agents are isocyanates having at least two isocyanate groups and adducts thereof. Specific examples thereof include aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols. Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have "v" of 0, namely compounds having only one functional group.

Listed as examples of silane compounds which can be employed as a cross-linking agent in the present invention are compounds represented by General Formal (1) or Formula (2), described in JP-A No. 2002-22203.

In these Formulas, $R_1$, $R_2$, $R_3$, $R_4$, $R_5$, $R_6$, $R_7$, and $R_8$ each represents a straight or branched chain or cyclic alkyl group having from 1 to 30 carbon atoms, which may be substituted, (such as a methyl group, an ethyl group, a butyl group, an octyl group, a dodecyl group, and a cycloalkyl group), an alkenyl group (such as a propenyl group, a butenyl group, and a nonenyl group), an alkynyl group (such as an acetylene group, a bisacetylene group, and a phenylacetylene group), an aryl group, or a heterocyclic group (such as a phenyl group, a naphthyl group, a tetrahydropyrane group, a pyridyl group, a furyl group, a thiophenyl group, an imidazole group, a thiazole group, a thiadiazole group, and an oxadiazole group, which may have either an electron attractive group or an electron donating group as a substituent.

At least one of substituents selected from $R_1$, $R_2$, $R_3$, $R_4$, $R_5$, $R_6$, $R_7$, and $R_8$ is preferably either a non-diffusive group or an adsorptive group. Specifically, $R^2$ is preferably either a non-diffusive group or an adsorptive group.

Incidentally, the non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of cross-linking agents. By introducing the non-diffusive groups, migration distance in the molecule at room temperature is retarded, whereby it is possible to retard reactions during storage.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by the following formula (EP):

formula (EP)

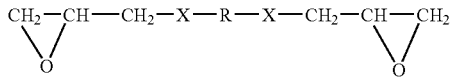

In the formula (EP), the substituent of the alkylene group represented by R is preferably a group selected from a halogen atom, a hydroxyl group, a hydroxyalkyl group, or an amino group. Further, the linking group represented by R preferably has an amide linking portion, an ether linking portion, or a thioether linking portion. The divalent linking group, represented by X, is preferably —$SO_2$—, —$SO_2NH$—, —S—, —O—, or —$NR_1$—, wherein $R_1$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/$m^2$, and is more preferably in the range of $1\times10^{-5}$ to $1\times10^{-3}$ mol/$m^2$.

The epoxy compounds may be incorporated in optional layers on the photosensitive layer side of a support, such as a photosensitive layer, a surface protective layer, an interlayer, an antihalation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by the following formula (SA) are preferred:

formula (SA)

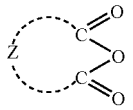

In the foregoing formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, the acid anhydrides may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

Image Tone Adjustment

The image tone (or image color) obtained by thermal development of the imaging material is described. It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In this invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Extensive investigation was performed for the silver salt photothermographic material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also from 0.998 to 1.000.

The value v* of the intersection point of the aforesaid linear regression line with the ordinate is −5-+5; and gradient (v*/u*) is 0.7 to 2.5.

(2) The coefficient of determination value $R^2$ of the linear regression line is 0.998 to 1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below. In this invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, image toning agents such as phthalazinones or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

Other than such image toning agents, it is preferable to control color tone employing couplers disclosed in JP-A No. 11-288057 and EP 1134611A2 as well as leuco dyes detailed below. Further, it is possible to unexpectedly minimize variation of tone during storage of silver images by simultaneously employing silver halide grains which are converted into an internal latent image-forming type after the thermal development according to the present invention.

Leuco dyes are employed in the silver salt photothermographic materials relating to this invention. There may be employed, as leuco dyes, any of the colorless or slightly tinted compounds which are oxidized to form a colored state when heated at temperatures of about 80 to about 200° C. for about 0.5 to about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include bisphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes and other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01 to 0.30, is preferably 0.02 to 0.20, and is most preferably 0.02 to 0.10. Further, it is preferable that images be controlled within the preferred color tone range described below.

The addition amount of cyan forming leuco dyes is usually 0.00001 to 0.05 mol/mol of Ag, preferably 0.0005 to 0.02 mol/mol, and more preferably 0.001 to 0.01 mol.

The compounds represented by the foregoing formula (YL) and cyan forming leuco dyes may be added employing the same method as for the reducing agents represented by the foregoing formual (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

To minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent. Herein, the variation coefficient of the particle size distribution refers to the value expressed by the formula described below:

[(Standard deviation of particle diameter)/(particle diameter average)]×100

Methods of adding the matting agent may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

It is preferable to employ the fluorinated surfactants represented by the following formulas (SA-1) to (SA-3) in the photothermographic materials:

$$(Rf\text{-}L)_p\text{-}Y\text{-}(A)_q \qquad \text{formula (SA-1)}$$

$$LiO_3S\text{—}(CF_2)_nSO_3Li \qquad \text{formula (SA-2)}$$

$$MO_3S\text{—}(CF_2)_n\text{—}SO_3M \qquad \text{formula (SA-3)}$$

wherein M represents a hydrogen atom, a sodium atom, a potassium atom, and an ammonium group; n represents a positive integer, while in the case in which M represents H, n represents an integer of 1 to 6 and 8, and in the case in which M represents an ammonium group, n represents an integer of 1 to 8.

In the foregoing formula (SA-1), Rf represents a substituent containing a fluorine atom. Fluorine atom-containing substituents include, for example, an alkyl group having 1 to 25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

L represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

Y represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorinated surfactants represented by the foregoing formula (SA-1) are prepared as follows. Alkyl compounds having 1 to 25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the tri- to hexa-valent alknaol compounds into which fluorine atom(s) are not introduced, aromatic compounds having 3 or 4 hydroxyl groups or hetero compounds. Anion group (A) is further introduced into the resulting compounds (including alknaol compounds which have been partially subjected to introduction of Rf) employing, for example, sulfuric acid esterification.

Examples of the aforesaid tri- to hexa-valent alkanol compounds include glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl)propane, 2,2-bis(butanol), aliphatic triol, tetramethylolmethane, D-sorbitol, xylitol, and D-mannitol. The aforesaid aromatic compounds, having 3-4 hydroxyl groups and hetero compounds, include, for example, 1,3,5-trihydroxybenzene and 2,4,6-trihydroxypyridine.

In formula (SA-2), "n" is an integer of 1 to 4.

In the foregoing formula (SA-3), M represents a hydrogen atom, a potassium atom, or an ammonium group and n represents a positive integer. In the case in which M represents H, n represents an integer from 1 to 6 or 8; in the case in which M represents Na, n represents 4; in the case in which M represents K, n represents an integer from 1 to 6; and in the case in which M represents an ammonium group, n represents an integer from 1 to 8.

It is possible to add the fluorinated surfactants represented by the formulas (SA-1) to (SA-3) to liquid coating compositions, employing any conventional addition methods known in the art. Thus, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorinated surfactants are added to the protective layer which is the outermost layer.

The added amount of the aforesaid fluorinated surfactants is preferably $1\times10^{-8}$ to $1\times10^{-1}$ mol per $m^2$. When the added amount is less than the lower limit, it is not possible to achieve desired charging characteristics, while it exceeds the upper limit, storage stability degrades due to an increase in humidity dependence.

Surfactants represented by the foregoing formulas (SA-1), (SA-2), and (SA-3) are disclosed in JP-A No. 2003-57786, and Japanese Patent Application Nos. 2002-178386 and 2003-237982.

Materials for the support employed in the photothermographic material are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

To minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic material relating to this invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

For example, when the silver salt photothermographic dry imaging material of the present invention is used as an image recording material utilizing infrared radiation, it is preferable to employ squalilium dyes having a thiopyrylium nucleus (hereinafter referred to as thiopyriliumsqualilium dyes) and squalilium dyes having a pyrylium nucleus (hereinafter referred to as pyryliumsqualilium dyes), as described in Japanese Patent Application No. 11-255557, and thiopyryliumcroconium dyes or pyryliumcroconium dyes which are analogous to the squalilium dyes.

Incidentally, the compounds having a squalilium nucleus, as described herein, refers to ones having 1-cyclobutene-2-hydroxy-4-one in their molecular structure. Herein, the hydroxyl group may be dissociated. Hereinafter, all of these dyes are referred to as squalilium dyes. There are also preferably employed as a dye compounds described in JP-A No. 8-201959.

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.1 to 2.5 g/m$^2$, and is more preferably from 0.5 to 1.5 g/m$^2$. Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$. The ratio of the silver coverage which is resulted from silver halide is preferably from 2 to 18 percent with respect to the total silver, and is more preferably from 3 to 15 percent. Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$. Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g. When coating is carried out under conditions within the aforesaid range, from the viewpoint of maximum optical silver image density per definite silver coverage, namely covering power as well as silver image tone, desired results are obtained.

When the photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a preferable method is the method utilizing a laser scanning exposure apparatus in which the angle between the scanning surface of a photosensitive material and the scanning laser beam does not substantially become vertical. "Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode. The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

In the recording methods of the aforesaid first and second embodiments, it is possible to suitably select any of the following lasers employed for scanning exposure, which are generally well known, while matching the use. The foregoing lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm. The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When the heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will be further described based on examples but is by no means limited to these.

Example 1

| Preparation of Silver Halide Emulsion A | |
|---|---|
| Solution A1 | |
| Phenylcarbamoyl-modified gelatin | 88.3 g |
| Compound (AO-1)* (10% aqueous methanol solution) | 10 ml |
| Potassium bromide | 0.32 g |
| Water to make | 5429 ml |
| Solution B1 | |
| 0.67 mol/L aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| Solution E1 | |
| 0.4 mol/L aqueous potassium bromide solution in an amount to control silver potential | |
| Solution F1 | |
| Potassium hydroxide | 0.71 g |
| Water to make | 20 ml |
| Solution G1 | |
| 56% aqueous acetic acid solution | 18.0 ml |
| Solution H1 | |
| Sodium carbonate anhydride | 1.72 g |
| Water to make | 151 ml |

*Compound (A: $HO(CH_2CH_2O)_n(CH(CH_3)CH_2O)_{17}(CH_2CH_2O)_mH$ (m + n = 5 to 7)

Upon employing a mixing stirrer shown in JP-B No. 58-58288, ¼ portion of solution B1 and whole solution C1 were added to solution A1 over 4 minutes 45 seconds, employing a double-jet precipitation method with adjusting the temperature to 32° C. and the pAg to 8.09, whereby nuclei were formed. After one minute, whole solution F1 was added. During the addition, the pAg was appropriately adjusted employing Solution E1. After 6 minutes, ¾ portions of solution B1 and whole solution D1 were added over 14 minutes 15 seconds, employing a double-jet addition method while adjusting the temperature to 32° C. and the pAg to 8.09. After stirring for 5 minutes, the mixture was heated to 40° C., and whole solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H1 was added and the resultant mixture was heated to 60° C., and then stirred for an additional 120 minutes. Finally, the pH was adjusted to 5.8 and water was added so that the weight was adjusted to 1,161 g per mol of silver, whereby a light-sensitive silver halide emulsion A was prepared.

The prepared emulsion was comprised of monodisperse cubic silver iodobromide grains having an average grain size of 0.040 μm, 12 percent of a coefficient of variation of grain size (hereinafter, also denoted as a grain size variation coefficient) and a (100) crystal face ratio of 92 percent.

Preparation of Organic Silver Salt Composition

Figure 1:
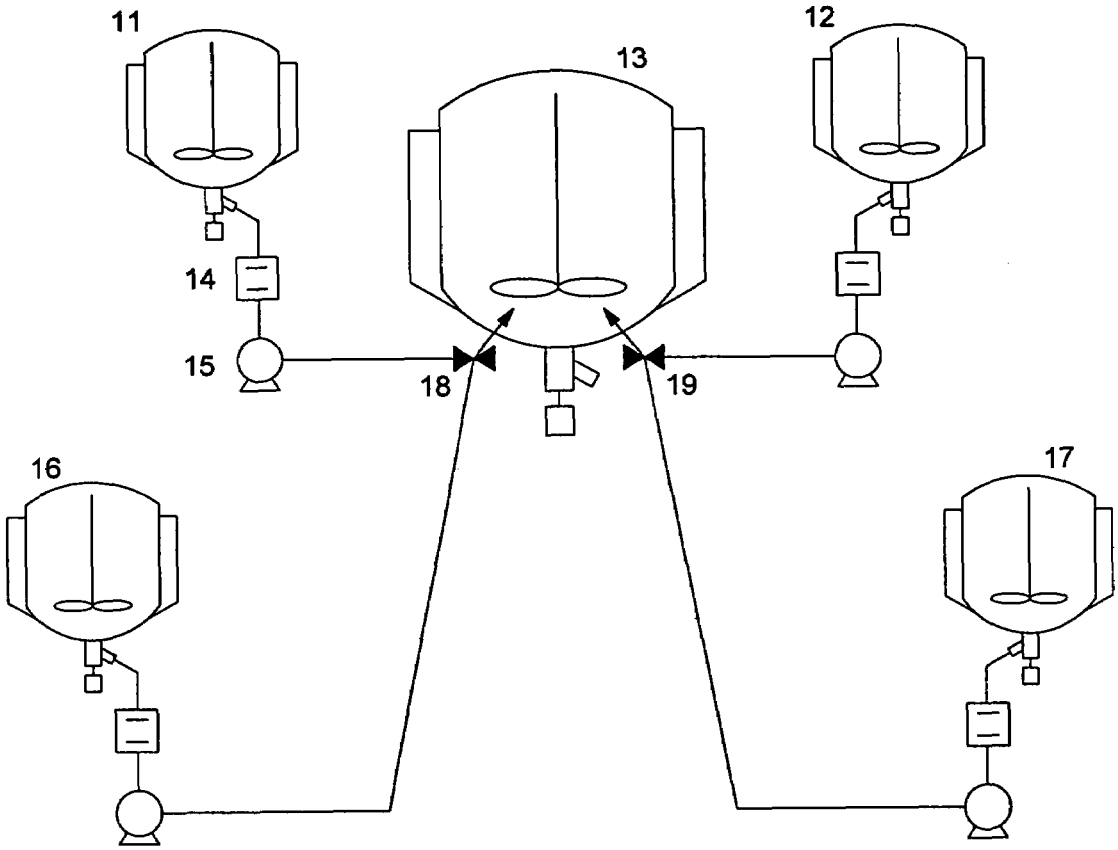
FIG. 1 illustrates an apparatus for manufacturing an organic silver salt composition.

Organic silver salt composition (1-1) was prepared using an apparatus, as shown FIG. 1. In tank (11), 0.3 mol of stearic acid (St) as organic acid (A) and 1710 ml of pure water were mixed with an aqueous 1.5 mol/L KOH solution in an amount of 90 mol % of the organic acid (A) and reacted for 60 min. at 80° C. to obtain organic acid alkali metal salt solution (A). Into tank (12), an aqueous 1 mol/L silver nitrate solution was put in an amount 89 mol % of the organic acid (A) to prepare a first silver ion containing solution and maintained at 10° C.

In tank (16), 0.7 mol of behenic acid (Bhe) as organic acid (B) and 3990 ml of pure water were mixed with an aqueous 5 mol/L KOH solution in an amount of 94 mol % of the organic acid (B) and reacted for 60 min. at 80° C. to obtain organic acid alkali metal salt solution (B). Into tank (17), an aqueous 1 mol/L silver nitrate solution was put in an amount 93 mol % of the organic acid (A) to prepare a second silver ion containing solution and maintained at 10° C. In tank (13), 6 lit. of pure water was maintained at 30° C.

To the tank (13), the organic acid alkali metal salt solution (A) and the first silver ion containing solution were each added at a constant flow rate over a period of 12 min. with stirring, in which the flow rate was controlled using a flowmeter (14) and a pump (15). For 60 sec. after starting the addition of the silver ion containing solution, only the first silver ion containing solution was added and then addition of the organic acid alkali metal salt solution (A) was started. Accordingly, for 60 sec after completing the addition of the first silver ion containing solution, only the organic acid alkali metal salt solution (A) was added. After completing the addition of the organic acid alkali metal salt solution (A), the reaction mixture was further stirred for 5 min., in which a sample for analysis was withdrawn.

Thereafter, operating transfer valves (18) and (19), addition of the organic acid alkali metal salt solution (B) and the second silver ion containing solution was started. For 60 sec. after starting the addition of the silver ion containing solution, only the second silver ion containing solution was added and then addition of the organic acid alkali metal salt solution (B) was started. Accordingly, for 60 sec after completing the addition of the first silver ion containing solution, only the organic acid alkali metal salt solution (B) was added. The reaction tank (13) was maintained at 30° C. and external temperature control was conducted to keep a constant solution temperature. In the pipeline for an addition system of organic acid alkali metal salt solution, hot water was circulated through the outer side of a double pipe to perform hot insulation and adjusted so that the liquid temperature of the outlet at the top of an addition nozzle was 80° C. In the pipeline for an addition system of aqueous silver nitrate solution, cold water was circulated through the outer side of a double pipe to perform cold insulation. The position of the respective nozzles was set so that the addition position of the organic acid alkali metal solution and that of the silver nitrate solution were symmetrically arranged centering around the stirring axis. After completing the addition, stirring was further continued for 10 min. with maintaining the temperature to obtain an organic silver salt composition.

The thus obtained organic silver salt composition was mixed with 60 g of the foregoing light-sensitive silver halide emulsion A which was further dissolved in 100 ml of pure water, and stirred for 5 min. Then, solids were filtered off by suction filtration and washed with water until permeated water reached a conductivity of 30 μS/cm. The dewatered cake was dried at 40° C. for 72 hr to obtain organic silver salt composition (1-1) containing light-sensitive silver halide.

Organic silver salt compositions (1-2) to (1-4) were prepared similarly to the foregoing organic silver salt composition (1-1), except that an organic acid, alkali, silver nitrate and the addition time were changed as shown in Table 2.

TABLE 2

| Organic | Organic Acid Alkali Metal Salt Solution (A) | | | | 1st Silver Ion Solution | | Organic Acid Alkali Metal Salt Solution (B) | | | | 2nd Silver Ion Solution | |
|---|---|---|---|---|---|---|---|---|---|---|---|---|
| Silver Salt Composition | Acid A (mol) | Water (ml) | Alkali (mol %*1) | Add. Time (min) | Silver Nitrate (mol %*1) | Add. Time (min) | Acid B (mol) | Water (ml) | Alkali (mol %*2) | Add. Time (min) | Silver Nitrate (mol %*2) | Add. Time (min) |
| 1-1 | St(0.3) | 1710 | 90 | 12 | 89 | 12 | Bhe(0.7) | 3990 | 94 | 28 | 93 | 28 |
| 1-2 | St(0.3) | 1710 | 95 | 12 | 94 | 12 | Bhe(0.7) | 3990 | 92 | 28 | 91 | 28 |
| 1-3 | St(0.3) | 1710 | 98 | 12 | 250 | 12 | Bhe(0.7) | 3990 | 90 | 28 | 24 | 28 |
| 1-4 | St(0.3) | 1710 | 100 | 12 | 305 | 12 | Bhe(0.7) | 3990 | 89 | 28 | 0 | 0 |

*1mol %, based on organic acid A
*2mol %, based on organic acid B

Analysis of the respective organic silver salt compositions was conducted in the following manner. Each of the foregoing organic silver salt compositions which were prior to being mixed with the light-sensitive silver halide emulsion A, was samples and dissolved with heating in 20 ml of solution of a mixture of concentrated sulfuric acid and nitric acid were in a ratio of 1:1. The solution was subjected to inductively coupled plasma emission spectroscopy (ICP-AES) to determine the silver content. Using an ICP-AES apparatus (SPS-4000, produced by Seiko Denshi Co., Ltd.) at a measurement wavelength of 328.068 nm, the determination was made based on a calibration curve method. The determination of organic silver salt A was made using a sample taken out in the midway, and the content of organic silver salt B was determined from the difference between finally obtained organic silver salt and organic silver salt A.

Analysis of organic acid which was not converted to its silver salt, was conducted in the following manner. Thus, a free organic acid contained in the individual sample was methylated and the content of the methylated organic acid was determined using gas chromatograph/mass spectrometer (GC/MS). Thus, 10 mg of a sample was weighed and after adding ethanol thereto, the sample was dispersed by ultrasonic waves, filtered, concentrated and dried. Further thereto, methanol and 4M HCl were added and refluxed to obtain a methylated organic acid. To the reaction mixture, ethyl acetate and water were added and the methylated organic acid was extracted, concentrated and dried. The thus dried product was dissolved in ethyl acetate, and an internal reference (methyl lignocerate) was added, made up to 10 ml and analyzed using a gas chromatograph/mass spectrometer (GC/MS). There were employed a GC/MS apparatus, 6890GC/5973MSD, produced by Azilent Technology Co. and separation column, DB-WAX (0.25 mm i.d.×30 m), produced by J & W Corp. Gas chromatography (GC) was conducted under the following conditions:

injection: 250° C.

transfer line: 280° C.

Oven: initial temperature of 200° C.

temperature increase: 5° C./min final temperature: 280° C. (retained for 10 min.).

The mass spectrometer was operated at an ion monitoring mode (SIM) and an peak intensity of m/z=74 was used for determination. The value obtained from the foregoing treatment was that of a methylated organic acid, which was converted to that of a free organic acid. Analysis results of the individual organic silver salt are shown in Table 3, in which "Content" indicates the proportion (mol %) of free organic acids, based on organic acids and organic silver salts contained in the organic silver salt composition.

TABLE 3

| Organic | Organic Silver Salt | | Organic Acid | | | |
|---|---|---|---|---|---|---|
| Silver Salt Composition | A (mol %) | B (mol %) | A (mol %) | B (mol %) | Content (mol %)*1 | Remark |
| 1-1 | 29.5 | 70.5 | 40.2 | 59.8 | 8.2 | Comp. |
| 1-2 | 30.7 | 69.3 | 22.5 | 77.5 | 8.1 | Inv. |
| 1-3 | 32.1 | 67.9 | 7.3 | 92.7 | 8.3 | Inv. |
| 1-4 | 32.8 | 67.2 | 0.3 | 99.7 | 8.4 | Inv. |

*1Content (mol %) of organic acids of the composition

Preparation of Light-sensitive Emulsion A-1

In 728.5 g of methyl ethyl ketone (hereinafter referred to as MEK) was dissolved 7.3 g of compound P-9 shown in Table 1. While stirring by dissolver DISPERMAT Type CA-40M (manufactured by VMA-Getzmann Co.), 250 g of the foregoing powdery organic silver salt (1-1) was gradually added and sufficiently mixed, and preliminary dispersion A-1 was thus prepared.

The thus prepared preliminary dispersion A-1 was charged into a media type homogenizer DISPERMAT Type SL-C12EX (manufactured by VMA-Getzmann Co.), filled with 0.5 mm diameter zirconia beads (Toreselam, produced by Toray Co.) so as to occupy 80 percent of the interior volume so that the retention time in the mill reached 1.5 minutes and was dispersed at a peripheral rate of the mill of 8 m/second to prepare light-sensitive emulsion A-1.

Preparation of Light-sensitive Emulsion A-2 to A-4

Light-sensitive emulsions A-2 to A-4 were prepared similarly to the foregoing light-sensitive emulsion A-1, except that the powdery organic silver salt (1-1) was replaced respectively by powdery organic silver salts (1-2) to (1-4).

Preparation of Support

On one sides of blue-tinted polyethylene terephthalate film (having a thickness of 175 μm) exhibiting a density of 0.170 which was previously subjected to a corona discharge treatment at 0.5 kV·A·min/m$^2$, sublayer coating solution A was coated to form sublayer (a) having a dry thickness of 0.2 μm. Further on the other side of the film which was previously subjected to a corona discharge treatment at 0.5 kV·A·min/m$^2$, sublayer coating solution B was coated to for sublayer (b) having a dry thickness of 0.1 μm. Thereafter, a heating treatment was conducted at 130° C. for 15 min in a heating treatment type oven having a film transport apparatus provided with plural rolls.

Sublayer Coating Solution A

Copolymer latex solution (30% solids) of 270 g, comprised of 30% by weight of n-butyl acrylate, 20% by weight of t-butyl acrylate, 25% by weight of styrene and 25% by weight of 2-hydroxyethyl acrylate was mixed with 0.6 g of compound (UL-1) and 1 g of methyl cellulose. Further thereto a dispersion in which 1.3 g of silica particles (SILOID, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sublayer coating solution A.

Sublayer Coating Solution B

Colloidal tin oxide dispersion of 37.5 g was mixed with 3.7 g of copolymer latex solution (30% solids) comprised of 20% by weight of n-butyl acrylate, 30% by weight of t-butyl acrylate, 25% by weight of styrene and 25% by weight of 2-hydroxyethyl acrylate, 14.8 g of copolymer latex solution (30% solids) comprised of 40% by weight of n-butyl acrylate, 20% by weight of styrene and 40% by weight of glycidyl methacrylate, and 0.1 g of surfactant UL-1 (as a coating aid) and water was further added to make 1000 ml to obtain sublayer coating solution B.

Colloidal Tin Oxide Dispersion

Stannic chloride hydrate of 65 g was dissolved in 2000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount of 2000 ml. After adding 40 ml of 30% ammonia water was added and heated, heating was further continued and concentrated to 470 ml to obtain colloidal tin oxide dispersion.

UL-1

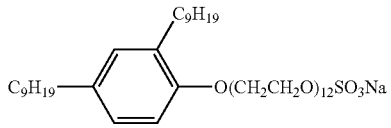

Preparation of Photothermographic Material

Photothermographic material sample 1 was prepared according to the following procedure.

Back Layer Coating

While 830 g of MEK, 84.2 g of cellulose acetate butyrate (CAB381-20, produced by Eastman Chemical Co.) and 4.5 g of polyester resin (Vitel PE2200B, produced by Bostic Co.) were added thereto and dissolved. To this solution, 0.3 g of infrared dye 1 was added. Further thereto, 4.5 g of a fluorinated surfactant-1 and 1.5 g of a fluorinated surfactant (FTOP EF-105, produced by JEMCO Corp.) were added and sufficiently stirred until being dissolved. Finally, 75 g of silica (SISILIA 450, Fuji Silisia Co.) which was previously dispersed in MEK at a concentration of 1% by weight using a dissolver type homogenizer, was added with stirring to prepare a coating solution for the back layer.

fluorinated surfactant-1 $C_9F_{17}O(CH_2CH_2O)_{22}C_9F_{17}$

Subsequently, the thus prepared coating solution of a back layer was coated on on the sublayer (b) of the support, using an extrusion coater and dried to form a dry thickness of 3.5 μm. Drying was conducted over 5 min. using hot air at a dry bulb temperature of 100° C. and a dew point of 10° C.

Infrared Dye 1

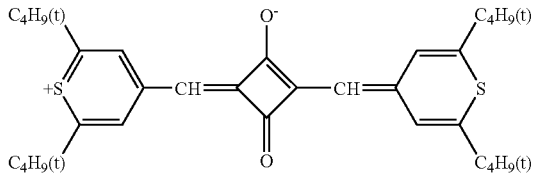

Light-sensitive Layer Side Coating

The additive solutions were prepared according to the following procedure.

Preparation of Stabilizer Solution

Stabilizer solution was prepared by dissolving 1.0 g of stabilizer-1 and 0.31 g of potassium acetate in 4.97 g of methanol.

Preparation of Infrared Sensitizing Dye A Solution

Infrared sensitizing dye A solution was prepared by dissolving 19.2 mg of infrared sensitizing dye-1, 1.488 g of 2-chloro-benzoic acid, 2.779 g of stabilizer 2, and 365 mg of 5-methyl-2-mercaptobenzimidazole in 31.3 ml of MEK in a dark room.

Preparation of Additive Solution (a)

Additive solution a was prepared by dissolving 27.98 g of reducing agent RED-12, 1.54 g of 4-methylphthalic acid and 0.48 g of the foregoing infrared dye 1 in 100.7 g of methyl ethyl ketone.

Preparation of Additive Solution (b)

Additive Solution b was prepared by dissolving 3.56 g of Antifoggant 2, and 3.43 g of phthalazine in 40.9 g of methyl ethyl ketone.

Preparation of Light-sensitive Layer Coating Solution

While stirring, 50 g of the foregoing light-sensitive emulsion A-1 and 15.11 g of methyl-ethyl ketone were mixed and the resultant mixture was maintained at 21° C., then, 390 μm of antifoggant-1 (10% methanol solution) was added thereto and stirred for 1 hr. Further, 494 μl of calcium bromide (10% methanol solution) was added and after stirred for 20 minutes. Subsequently, 167 ml of the foregoing stabilizer solution was added and stirred for 10 minutes. Thereafter, 1.32 g of the foregoing infrared sensitizing dye A was added and the resulting mixture was stirred for one hour. Subsequently, the resulting mixture was cooled to 13° C. and stirred for 30 min. While maintaining at 13° C., 13.31 g of the binder (P-9 shown in Table 1) was added and stirred for 30 min. Thereafter, 1.084 g of tetrachlorophthalic acid (9.4% MEK solution) was added and stirred for 15 minutes. Further, while stirring, 12.43 g of additive solution (a), 1.6 ml of Desmodur N300 (aliphatic isocyanate, manufactured by Mobay Chemical Co. 10% MEK solution), and 4.27 g of additive solution (b) were successively added, whereby light-sensitive layer coating composition A-1 was obtained.

Stabilizer-1

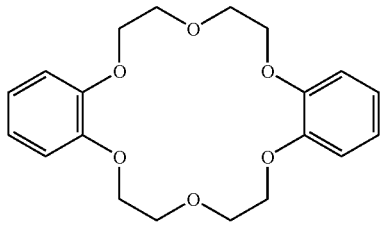

Stabilizer-2

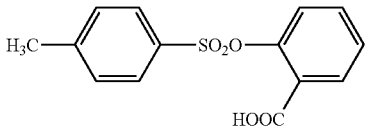

Infrared Sensitizing Dye-1

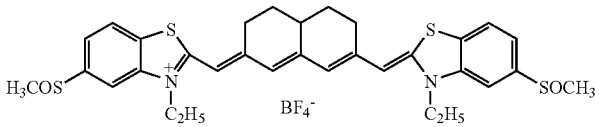

Antifoggant-2

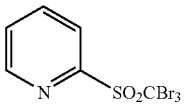

-continued

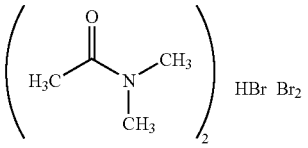

Antifoggant-1

Protective Layer Coating Solution

To 865 g of methyl ethyl ketone were added 96 g of cellulose acetate butyrate (CAB 171-15, as afore-described), polymethyl methacrylate (Paraloid A-21, Rohm & Haas Co.), 10 g of benzotriazole and 1.0 g of a fluorinated surfactant (FTOP EF-105, produced by JEMCO Corp.) with stirring. Then, 30 g of the following matting agent dispersion was added thereto with stirring to prepare a coating solution of a surface protective layer.

Matting Agent Dispersion

In 42.5 g of methyl ethyl ketone was dissolved cellulose acetate butyrate (CAB 171-15, produced by Eastman Chemical Co.) and further thereto, 5 g of particulate silica (SISILIA 320, Fuji Silisia Co.) was added and dispersed using a dissolver type homogenizer for 30 min. at 8,000 rpm to prepare a matting agent dispersion.

The thus prepared light-sensitive layer coating solution A-1 and the surface protective layer coating solution were simultaneously coated using a conventionally known extrusion coater so that the silver coating amount of the light-sensitive layer was 1.7 g/m$^2$ and the dry thickness of the protective layer was 2.5. Drying was conducted for 10 min. using hot air at a dry bulb temperature of 75° C. and a dew point of 10° C. to prepare sample 101.

Preparation of Sample 102 to 104.

Photothermographic material samples 102 to 104 were prepared similarly to the foregoing sample 101, except that organic light-sensitive emulsion A-1 was replaced respectively by light-sensitive emulsion A-2, A-3 and A-4.

Evaluation of Photothermographic Material

The thus prepared samples 101 to 104 were evaluated as follows.

Photographic Performance of Fresh Sample

The light-sensitive layer side of each of fresh photothermographic samples was exposed using a laser sensitometer provided with 810 nm semiconductor laser and thermally developed at 123° C. for 8 sec. using an automatic processor provided with a heat drum, with bringing the protective layer of the photothermographic material into contact with the heat drum. The exposure and thermal development were conducted in the room conditioned at 23° C. and 50% RH. The thus processed samples were each subjected to sensitometry using a densitometer PDA-65, produced by Konica Minolta Inc. to determine fog and sensitivity.

Thus, the transmission density of the unexposed area was measured to three places of decimals and the values obtained at ten points were averaged and defined as a fog density (also denoted simply as F). Sensitivity (also denoted simply as S) was represented by a relative value of the reciprocal of the exposure amount necessary to give a density of the unexposed area density plus 1.0, based on the sensitivity of sample 1 being 100.

Image Color

Processed samples were each visually evaluated with respect to image color in the vicinity of a density of 1.0, based on the following criteria:

5: a level of color tone sample acceptable as standard,

4: a slightly inferior level to the foregoing,

3: practically acceptable level,

2: brownish and inferior level,

1: markedly brownish and unacceptable level.

Raw Stock Stability

The respective samples were each two groups, which were sealed in 25 μm thick aluminum envelops. One of them was aged for 3 days at 25° C., and the other one was aged for 3 days at 55° C. Thereafter, the thus aged samples were processed similarly to fresh samples and determined with respect to fog density and sensitivity. The samples aged at 25° C. and 55° C. were evaluated with respect to raw stock stability, based on the difference in fog density or sensitivity between the samples aged at 25° C. and 55° C. (which were denoted as ΔF and ΔS).

Image Storage Stability

Processed samples were allowed to stand on the viewing lantern for 10 hrs, and evaluated with respect to image color.

Results are shown in Table 4.

TABLE 4

| | Photographic Performance (fresh) | | | Raw Stock Stability | | | Image Storage Stability | |
|---|---|---|---|---|---|---|---|---|
| Sample No. | Fog | S | Image Color | ΔFog | ΔS | Image Color | Image Color | Remark |
| 101 | 0.195 | 100 | 3 | 0.095 | 18 | 1 | 2 | Comp. |
| 102 | 0.188 | 106 | 5 | 0.036 | 5 | 4 | 4 | Inv. |
| 103 | 0.185 | 105 | 5 | 0.031 | 3 | 5 | 5 | Inv. |
| 104 | 0.186 | 108 | 5 | 0.024 | 2 | 5 | 5 | Inv. |

As apparent from Table 4, it was proved that photothermographic material samples of this invention exhibited superior photographic performance and improved raw stock stability and image storage stability, even when rapidly processed for 8 sec.

Example 2

Organic silver salt compositions (2-1) to (2-5) were prepared similarly to the organic silver salt composition (1-1), provided that organic acid, alkali, silver nitrate or addition time was varied as shown in Table 5.

TABLE 5

| Organic Silver Salt Composition | Organic Acid Alkali Metal Salt Solution (A) Acid A (mol) | Water (ml) | Alkali (mol %*1) | Add. Time (min) | 1st Silver Ion Solution Silver Nitrate (mol %*1) | Add. Time (min) | Organic Acid Alkali Metal Salt Solution (B) Acid B (mol) | Water (ml) | Alkali (mol %*2) | Add. Time (min) | 2nd Silver Ion Solution Silver Nitrate (mol %*2) | Add. Time (min) |
|---|---|---|---|---|---|---|---|---|---|---|---|---|
| 2-1 | St(0.8) | 4560 | 98.5 | 32 | 115.8 | 32 | Bhe(0.2) | 1140 | 70 | 8 | 0 | 0 |
| 2-2 | St(0.6) | 3420 | 98 | 24 | 154 | 24 | Bhe(0.4) | 2280 | 85 | 16 | 0 | 0 |
| 2-3 | St(0.33) | 1881 | 96.3 | 13.2 | 96.3 | 13.2 | Bhe(0.67) | 3819 | 91.5 | 26.8 | 91 | 26.8 |
| 2-4 | St(0.15) | 855 | 92 | 6 | 92 | 6 | Bhe(0.85) | 4845 | 93.5 | 34 | 93 | 34 |
| 2-5 | St(0.08) | 456 | 85 | 3.2 | 85 | 3.2 | Bhe(0.92) | 5244 | 94 | 36.8 | 93 | 36.8 |

*1mol %, based on organic acid A
*2mol %, based on organic acid B

Results of analysis of the individual organic silver salt composition are shown in Table 6

TABLE 6

| Organic Silver Salt Composition | Organic Silver Salt A (mol %) | B (mol %) | Organic Acid A (mol %) | B (mol %) | Content (mol %)*1 | Remark |
|---|---|---|---|---|---|---|
| 2-1 | 85.1 | 14.9 | 16.2 | 83.8 | 7.4 | Comp. |
| 2-2 | 63.6 | 36.4 | 15.8 | 84.2 | 7.6 | Inv. |
| 2-3 | 34.4 | 65.6 | 16.1 | 83.9 | 7.5 | Inv. |
| 2-4 | 14.9 | 85.1 | 15.8 | 84.2 | 7.6 | Inv. |
| 2-5 | 7.4 | 92.6 | 15.7 | 84.3 | 7.6 | Comp. |

*1Content (mol %) of free organic acids of the composition

Light-sensitive Emulsions B-1 to B-5 were prepared similarly to the light-sensitive emulsion A-1 in Example 1, except that powdery organic silver salt composition (1-1) containing silver halide grains was replaced by powdery organic silver salt compositions (2-1) to (2-5), respectively.

Photothermographic material samples 201 to 205 were prepared similarly to sample 101 in Example 1, except that the light-sensitive emulsion A-1 was replaced by the foregoing light-sensitive emulsion (B-1) to (B-2), respectively.

The thus prepared samples 201 to 205 were evaluated similarly to Example 1 with respect to photographic performance of fresh samples, raw stock stability and image storage stability. Sensitivity was represented by a relative value, based on the sensitivity of sample 201 being 100. Results thereof are shown in Table 7

TABLE 7

| Sample No. | Photographic Performance (fresh) Fog | S | Image Color | Raw Stock Stability ΔFog | ΔS | Image Color | Image Storage Stability Image Color | Remark |
|---|---|---|---|---|---|---|---|---|
| 201 | 0.191 | 100 | 4 | 0.051 | 10 | 1 | 1 | Comp. |
| 202 | 0.185 | 101 | 5 | 0.032 | 4 | 5 | 4 | Inv. |
| 203 | 0.186 | 102 | 5 | 0.029 | 3 | 5 | 5 | Inv. |
| 204 | 0.184 | 100 | 5 | 0.027 | 3 | 5 | 5 | Inv. |
| 205 | 0.184 | 87 | 2 | 0.026 | 3 | 2 | 2 | Comp. |

As apparent from Table 7, it was proved that photothermographic material samples of this invention exhibited superior photographic performance and improved raw stock stability and image storage stability, even when rapidly processed for 8 sec.

Example 3

Organic silver salt compositions (3-1) to (3-5) were prepared similarly to the organic silver salt composition (1-1), provided that organic acid, alkali, silver nitrate or addition time was varied as shown in Table 8.

TABLE 8

| Organic Silver Salt Composition | Organic Acid Alkali Metal Salt Solution (A) Acid A (mol) | Water (ml) | Alkali (mol %*1) | Add. Time (min) | 1st Silver Ion Solution Silver Nitrate (mol %*1) | Add. Time (min) | Organic Acid Alkali Metal Salt Solution (B) Acid B (mol) | Water (ml) | Alkali (mol %*2) | Add. Time (min) | 2nd Silver Ion Solution Silver Nitrate (mol %*2) | Add. Time (min) |
|---|---|---|---|---|---|---|---|---|---|---|---|---|
| 3-1 | St(0.4) | 2280 | 95 | 16 | 237.5 | 16 | Bhe(0.6) | 3420 | 96 | 24 | 0 | 0 |
| 3-2 | St(0.4) | 2280 | 98.8 | 16 | 244 | 16 | Bhe(0.6) | 3420 | 97.8 | 24 | 0 | 0 |
| 3-3 | St(0.4) | 2280 | 98 | 16 | 239.7 | 16 | Bhe(0.6) | 3420 | 95.5 | 24 | 0 | 0 |
| 3-4 | St(0.4) | 2280 | 96 | 16 | 229.5 | 16 | Bhe(0.6) | 3420 | 90 | 24 | 0 | 0 |
| 3-5 | St(0.4) | 2280 | 94 | 16 | 220 | 16 | Bhe(0.6) | 3420 | 85 | 24 | 0 | 0 |

*1mol %, based on organic acid A
*2mol %, based on organic acid B

TABLE 9

| Organic Silver Salt Composition | Organic Silver Salt A (mol %) | Organic Silver Salt B (mol %) | Organic Acid A (mol %) | Organic Acid B (mol %) | Organic Acid Content (mol %)*1 | Remark |
|---|---|---|---|---|---|---|
| 3-1 | 40.1 | 59.9 | 40.2 | 59.8 | 5.1 | Comp. |
| 3-2 | 40.5 | 59.9 | 20 | 80 | 2.4 | Inv. |
| 3-3 | 40.9 | 59.1 | 19.5 | 80.5 | 4.1 | Inv. |
| 3-4 | 41.8 | 58.2 | 19.4 | 80.6 | 8.2 | Inv. |
| 3-5 | 42.7 | 57.3 | 20.1 | 79.9 | 12.1 | Inv. |

*1Content (mol %) of free organic acids of the composition

Light-sensitive Emulsions. C-1 to C-5 were prepared similarly to the light-sensitive emulsion A-1 in Example 1, except that powdery organic silver salt composition (1-1) containing silver halide grains was replaced by powdery organic silver salt compositions (3-1) to (3-5), respectively.

Photothermographic material samples 301 to 305 were prepared similarly to sample 101 in Example 1, except that the light-sensitive emulsion A-1 was replaced by the foregoing light-sensitive emulsion (C-1) to (C-5), respectively.

The thus prepared samples 301 to 305 were evaluated similarly to Example 1 with respect to photographic performance of fresh samples, raw stock stability and image storage stability. Sensitivity was represented by a relative value, based on the sensitivity of sample 301 being 100. Results thereof are shown in Table 10

TABLE 10

| Sample No. | Photographic Performance (fresh) Fog | S | Image Color | Raw Stock Stability ΔFog | ΔS | Image Color | Image Storage Stability Image Color | Remark |
|---|---|---|---|---|---|---|---|---|
| 301 | 0.198 | 100 | 3 | 0.098 | 15 | 1 | 1 | Comp. |
| 302 | 0.184 | 103 | 4 | 0.026 | 3 | 4 | 4 | Inv. |
| 303 | 0.185 | 106 | 5 | 0.026 | 4 | 5 | 5 | Inv. |
| 304 | 0.186 | 108 | 5 | 0.027 | 3 | 5 | 5 | Inv. |
| 305 | 0.184 | 103 | 4 | 0.031 | 4 | 4 | 4 | Inv. |

As apparent from Table 10, it was proved that photothermographic material samples of this invention exhibited superior photographic performance and improved raw stock stability and image storage stability, even when rapidly processed for 8 sec.

Example 4

Organic silver salt compositions (4-1) to (4-6) were prepared similarly to the organic silver salt composition (1-1), provided that organic acid, alkali, silver nitrate or addition time was varied as shown in Table 11.

TABLE 11

| Organic Silver Salt Composition | Organic Acid Alkali Metal Salt Solution (A) Acid A (mol) | Water (ml) | Alkali (mol %*1) | Add. Time (min) | 1st Silver Ion Solution Silver Nitrate (mol %*1) | Add. Time (min) | Organic Acid Alkali Metal Salt Solution (B) Acid B (mol) | Water (ml) | Alkali (mol %*2) | Add. Time (min) | 2nd Silver Ion Solution Silver Nitrate (mol %*2) | Add. Time (min) |
|---|---|---|---|---|---|---|---|---|---|---|---|---|
| 4-1 | St(0.5) | 2850 | 91 | 20 | 182 | 20 | Bhe(0.5) | 2850 | 92 | 20 | 0 | 0 |
| 4-2 | St(0.45) | 2565 | 98 | 18 | 202.2 | 18 | Bhe(0.55) | 3135 | 86.3 | 22 | 0 | 0 |
| 4-3 | St(0.2) | 1140 | 97.5 | 8 | 255 | 8 | Bhe(0.8) | 4560 | 90.4 | 32 | 50 | 32 |
| 4-4 | St(0.2) | 1140 | 100 | 8 | 295.1 | 8 | Bhe(0.8) | 4560 | 89.8 | 32 | 40 | 32 |
| 4-5 | St(1) | 5700 | 92 | 40 | 91 | 40 | — | — | — | — | — | — |
| 4-6 | Bhe(1) | 5700 | 92 | 40 | 91 | 40 | — | — | — | — | — | — |

*1mol %, based on organic acid A
*2mol %, based on organic acid B

DSC Measurement

Using differential scanning calorimeter DSC-7, produced by Perkin-Elmer Co., organic silver salt compositions were each subjected to differential scanning calorimetry (DSC), in which the temperature was increased at a rate of 10° C./min from 0° C. to 200° C. (denoted as 1st scan). Subsequently, after allowed to stand for 1 min. at 200° C., the temperature was decreased to 0° C. at a rate of 10° C./min. After allowed to stand for 1 min. at 0° C., the temperature was again increased to 200° C. at a rate of 10° C./min (denoted as 2nd scan) to determine the respective endothermic peaks. Results of the foregoing DSC analysis of the respective organic silver salt compositions are shown in Table 12.

TABLE 12

| Organic Silver Salt Composition | 1st Scan (° C.) Organic Acid | Organic Acid Silver Salt | 2nd Scan (° C.) Organic Acid Silver Salt | Remark |
|---|---|---|---|---|
| 4-1 | 56.7 | 119.2 | 132.5 | Comp. |
| 4-2 | 68.5 | 114.5 | 135.8 | Inv. |
| 4-3 | 70.1 | 115.4 | 132.4 | Inv. |
| 4-4 | 71.4 | 115.3 | 132.5 | Inv. |
| 4-5 | 63.1 | 121.3 | 146.9 | Comp. |
| 4-6 | 71.5 | 125.1 | 138.7 | Comp. |

Light-sensitive Emulsions D-1 to D-6 were prepared similarly to the light-sensitive emulsion A-1 in Example 1, except that powdery organic silver salt composition (1-1)

containing silver halide grains was replaced by powdery organic silver salt compositions (4-1) to (4-6), respectively.

Photothermographic material samples 401 to 406 were prepared similarly to sample 101 in Example 1, except that the light-sensitive emulsion A-1 was replaced by the foregoing light-sensitive emulsion (D-1) to (D-6), respectively.

The thus prepared samples 401 to 406 were evaluated similarly to Example 1 with respect to photographic performance of fresh samples, raw stock stability and image storage stability. Sensitivity was represented by a relative value, based on the sensitivity of sample 401 being 100. Results thereof are shown in Table 10

TABLE 13

| Sample No. | Photographic Performance (fresh) | | | Raw Stock Stability | | | Image Storage Stability | |
|---|---|---|---|---|---|---|---|---|
| | Fog | S | Image Color | ΔFog | ΔS | Image Color | Image Color | Remark |
| 401 | 0.194 | 100 | 2 | 0.116 | 15 | 1 | 1 | Comp. |
| 402 | 0.183 | 107 | 5 | 0.031 | 4 | 5 | 5 | Inv. |
| 403 | 0.185 | 106 | 5 | 0.028 | 4 | 5 | 5 | Inv. |
| 404 | 0.184 | 106 | 5 | 0.026 | 3 | 5 | 5 | Inv. |
| 405 | 0.192 | 94 | 1 | 0.136 | 16 | 1 | 1 | Comp. |
| 406 | 0.197 | 82 | 4 | 0.030 | 9 | 4 | 2 | Comp. |

As apparent from Table 13, it was proved that photothermographic material samples of this invention exhibited superior photographic performance and improved raw stock stability and image storage stability, even when rapidly processed for 8 sec.

What is claimed is:

1. A method of manufacturing an organic silver salt composition comprising silver salts of at least two organic acids differing in melting point, the method comprising:

(i) preparing a solution of an organic acid A and allowing the acid A to react with an alkali to form an alkali metal salt of the organic acid A, (ii) preparing a solution of an organic acid B and allowing the acid B to react with an alkali to form an alkali metal salt of the organic acid B, and (iii) allowing each of the alkali metal salt of the organic acid A and the alkali metal salt of the organic acid B to react with a silver salt to form a silver salt of organic acid A and a silver salt of organic acid B, which are mixed to form an organic silver salt composition, wherein in (i) and (ii), the organic acid A has a lower melting point than the organic acid B and a molar ratio of the organic acid A to the organic acid B is in the range of 10:90 to 80:20; and the alkali metal salt of the organic acid A and the alkali metal salt of the organic acid B formed in (i) and (ii) each still contain an unreacted acid A and an unreacted acid B and a molar ratio of the unreacted acid A to the unreacted acid B is in the range of from 0:100 to 30:70, and steps (i) and (ii) are independently performed.

2. The method of claim 1, wherein the molar ratio of the organic acid A to the organic acid B is in the range of 10:90 to 50:50.

3. The method of claim 1, wherein the molar ratio of the unreacted acid A to the unreacted acid B is in the range of from 0:100 to 10:90.

4. The method of claim 1, wherein a total amount of the alkali of (i) and (ii) is 90 to 97 mol % of a total amount of the organic acids A and B of (i) and (ii).

5. The method of claim 1, wherein in (iii), the alkali metal salt of the organic acid A is allowed to react with a silver salt to form a silver salt of organic acid A and then the alkali metal salt of the organic acid B is allowed to react with a silver salt to form a silver salt of organic acid B.

6. The method of claim 1, wherein in (iii), the alkali metal salt of the organic acid B is allowed to react with a silver salt to form a silver salt of organic acid B and then the alkali metal salt of the organic acid A is allowed to react with a silver salt to form a silver salt of organic acid A.

7. The method of claim 1, wherein in (iii), the alkali metal salt of the organic acid A and the alkali metal salt of the organic acid B are simultaneously allowed to react with a silver salt to form a silver salt of organic acid A and a silver salt of organic acid B.

8. The method of claim 1, wherein the organic acid B is behenic acid.

* * * * *